US011789382B2

(12) United States Patent
Sato

(10) Patent No.: US 11,789,382 B2
(45) Date of Patent: Oct. 17, 2023

(54) IMAGE FORMING APPARATUS INCLUDING DRUM CARTRIDGE HAVING CUSHION MEMBER POSITIONED BETWEEN DEVELOPING CASING AND DEVELOPING SHUTTER

(71) Applicant: BROTHER KOGYO KABUSHIKI KAISHA, Nagoya (JP)

(72) Inventor: Shougo Sato, Seto (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 18/153,679

(22) Filed: Jan. 12, 2023

(65) Prior Publication Data

US 2023/0152731 A1 May 18, 2023

Related U.S. Application Data

(63) Continuation of application No. 17/330,806, filed on May 26, 2021, now Pat. No. 11,567,428.

(30) Foreign Application Priority Data

Jun. 30, 2020 (JP) ..... 2020-113268

(51) Int. Cl.
*G03G 15/08* (2006.01)
*G03G 21/00* (2006.01)
*G03G 21/18* (2006.01)

(52) U.S. Cl.
CPC ..... *G03G 15/0886* (2013.01); *G03G 21/1821* (2013.01); *G03G 15/0896* (2013.01);
(Continued)

(58) Field of Classification Search
CPC ..... G03G 15/0886; G03G 15/0877; G03G 15/0896; G03G 21/1821; G03G 2215/0692; G03G 2215/067
(Continued)

(56) References Cited

U.S. PATENT DOCUMENTS 7,668,489 B2 2/2010 Kim et al.
8,879,962 B2 11/2014 Sato
(Continued)

FOREIGN PATENT DOCUMENTS

JP 2003-066815 A 3/2003
JP 2010-256806 A 11/2010
(Continued)

*Primary Examiner* — Robert B Beatty
(74) *Attorney, Agent, or Firm* — Merchant & Gould P.C.

(57) ABSTRACT

An image forming apparatus includes: a main casing; a toner cartridge including a toner casing having a toner outlet for discharging toner in the toner cartridge and a toner shutter for opening and closing the toner outlet; a drum cartridge including a photosensitive drum and a developing unit including a developing casing having a toner inlet for receiving the toner from the toner cartridge, a developing shutter for opening and closing the toner inlet, and a cushion member positioned between the developing casing and the developing shutter. When the developing casing is moved relative to the photosensitive drum while the drum cartridge and the toner cartridge are attached to the main casing, the developing shutter opens the toner inlet, and the toner shutter opens the toner outlet, the cushion member allows movement of the developing casing relative to the developing shutter while the developing shutter engages with the toner cartridge.

10 Claims, 15 Drawing Sheets

(52) U.S. Cl.
CPC ..... *G03G 2215/067* (2013.01); *G03G 2215/0692* (2013.01)

(58) Field of Classification Search
USPC ..... 399/119, 258, 262
See application file for complete search history.

(56) References Cited

U.S. PATENT DOCUMENTS

| | | | |
|---|---|---|---|
| 2003/0039484 | A1 | 2/2003 | Naito et al. |
| 2010/0202803 | A1 | 8/2010 | Sato et al. |
| 2010/0272474 | A1 | 10/2010 | Sato |
| 2010/0329746 | A1 | 12/2010 | Sato |
| 2011/0103844 | A1 | 5/2011 | Sato |
| 2012/0099892 | A1 | 4/2012 | Sakai |
| 2012/0213567 | A1 | 8/2012 | Sato et al. |
| 2016/0313673 | A1 | 10/2016 | Eto |
| 2021/0405582 | A1 | 12/2021 | Sato |
| 2022/0011691 | A1 | 1/2022 | Sato |

FOREIGN PATENT DOCUMENTS

| | | | |
|---|---|---|---|
| JP | 2011-013368 | A | 1/2011 |
| JP | 2011-013373 | A | 1/2011 |
| JP | 2011-085961 | A | 4/2011 |
| JP | 2011-095578 | A | 5/2011 |
| JP | 2011-141573 | A | 7/2011 |
| JP | 2012-173457 | A | 9/2012 |

101

IMAGE FORMING APPARATUS INCLUDING DRUM CARTRIDGE HAVING CUSHION MEMBER POSITIONED BETWEEN DEVELOPING CASING AND DEVELOPING SHUTTER

REFERENCE TO RELATED APPLICATIONS

This application is a continuation of U.S. patent application Ser. No. 17/330,806, filed May 26, 2021, which claims priority from Japanese Patent Application No. 2020-113268 filed Jun. 30, 2020. The entire contents of the aforementioned applications are incorporated herein by reference.

BACKGROUND ART

Technical Field

The present disclosure relates to an image forming apparatus.

Background

A conventional image forming apparatus including a drum cartridge and a toner cartridge attachable to the drum cartridge is known. The drum cartridge includes a photosensitive drum and a developing unit for supplying toner to the photosensitive drum. The toner cartridge is capable of supplying toner to the developing unit in a state where the toner cartridge is mounted on the drum cartridge. The developing unit includes a developing roller, a developing casing, and a developing shutter. The developing casing supports the developing roller. The developing casing has a toner inlet allowing toner from the toner cartridge to enter the developing casing therethrough in the state where the toner cartridge is attached to the drum cartridge. The developing shutter is configured to open and close the toner inlet. In the meantime, the toner cartridge includes a toner casing and a toner shutter. The toner casing can accommodate toner therein. The toner casing has a toner outlet allowing the toner in the toner casing to be discharged to an outside therethrough. The toner shutter is configured to open and close the toner outlet (refer to Japanese Patent Application Publication No. 2003-66815).

DESCRIPTION

Summary

In the image forming apparatus disclosed in Japanese Patent Application Publication No. 2003-66815, a configuration is conceivable where the developing roller and the developing casing supporting the developing roller are movable relative to the photosensitive drum in order to suppress variation in a state of contact of the developing roller with the photosensitive drum.

However, when the developing casing is moved, there is a likelihood that a position of the toner inlet relative to the toner outlet changes, which may cause leakage of the toner in the toner cartridge that is to be supplied into the developing casing.

In view of the foregoing, it is an object of the present disclosure to provide an image forming apparatus in which toner is supplied from a toner cartridge to a developing casing movable relative to a photosensitive drum, and the toner in the toner cartridge can be suppressed from leaking when supplied to the developing casing.

In order to attain the above and other object, according to one aspect, the present disclosure provides an image forming apparatus including: a main casing; a toner cartridge; and a drum cartridge. The toner cartridge is attachable to the main casing. The toner cartridge includes: a toner casing for accommodating toner therein; and a toner shutter. The toner casing is formed with a toner outlet allowing the toner accommodated in the toner casing to be discharged to an outside of the toner casing therethrough. The toner shutter is movable between a toner closed position where the toner shutter closes the toner outlet and a toner open position where the toner shutter opens the toner outlet. The drum cartridge is attachable to the main casing and for receiving the toner from the toner cartridge in a state where the drum cartridge and the toner cartridge are attached to the main casing. The drum cartridge includes: a photosensitive drum; and a developing unit for supplying toner to the photosensitive drum. The photosensitive drum is rotatable about a drum axis extending in a first direction. The developing unit includes: a developing roller; and a developing casing; a developing shutter; and a cushion member. The developing roller is rotatable about a developing axis extending in the first direction. The developing casing supports the developing roller and is movable relative to the photosensitive drum in a second direction crossing the first direction. The developing casing is formed with a toner inlet allowing the toner discharged from the toner casing through the toner outlet to enter the developing casing therethrough. The developing shutter is movable between a developing closed position where the developing shutter closes the toner inlet and a developing open position where the developing shutter opens the toner inlet. The developing shutter is in engagement with the toner cartridge in the state where the drum cartridge and the toner cartridge are attached to the main casing. The cushion member is positioned between the developing casing and the developing shutter. When the developing casing is moved relative to the photosensitive drum in a state where the drum cartridge and the toner cartridge are attached to the main casing, the developing shutter is in the developing open position, and the toner shutter is in the toner open position, the cushion member allows the developing casing to be moved relative to the developing shutter while the developing shutter is in engagement with the toner cartridge.

BRIEF DESCRIPTION OF THE DRAWINGS

The particular features and advantages of the embodiment (s) as well as other objects will become apparent from the following description taken in connection with the accompanying drawings, in which.

DETAILED DESCRIPTION

Figure 1:
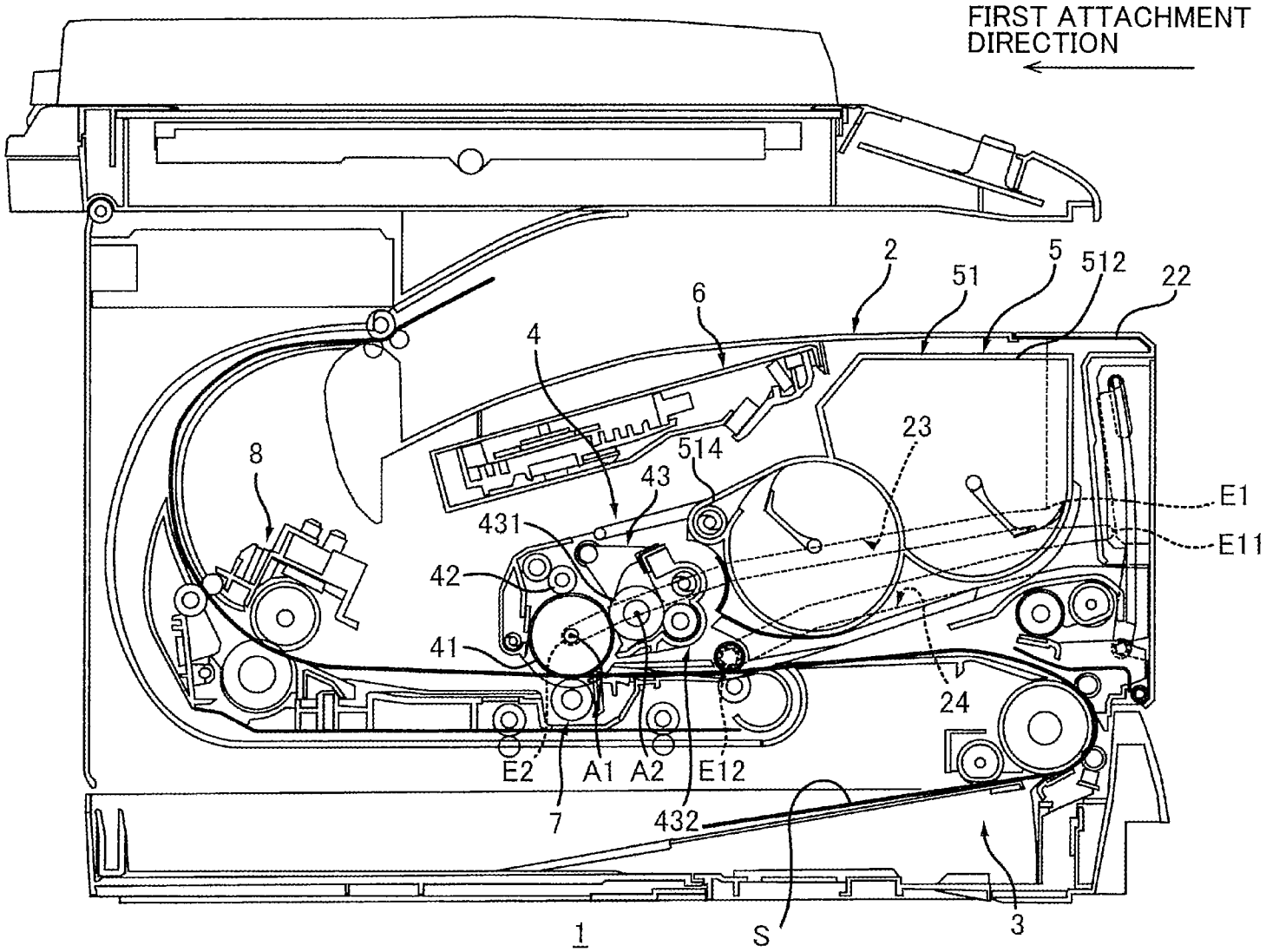
FIG. 1 is a diagram schematically illustrating a configuration of an image forming apparatus according one embodiment of the present disclosure.

Hereinafter, one embodiment of the present disclosure will be described while referring to the accompanying drawings.

<1. Image Forming Apparatus 1>

An overview of an image forming apparatus 1 according to the embodiment will be described with reference to FIGS. 1 and 2.

The image forming apparatus 1 includes a main casing 2, a sheet cassette 3, a drum cartridge 4, a toner cartridge 5, an exposure unit 6, a transfer unit 7, and a fixing unit 8.

<1.1. Main Casing 2>

The main casing 2 accommodates therein the sheet cassette 3, the drum cartridge 4, the toner cartridge 5, the exposure unit 6, the transfer unit 7, and the fixing unit 8.

Figure 2:
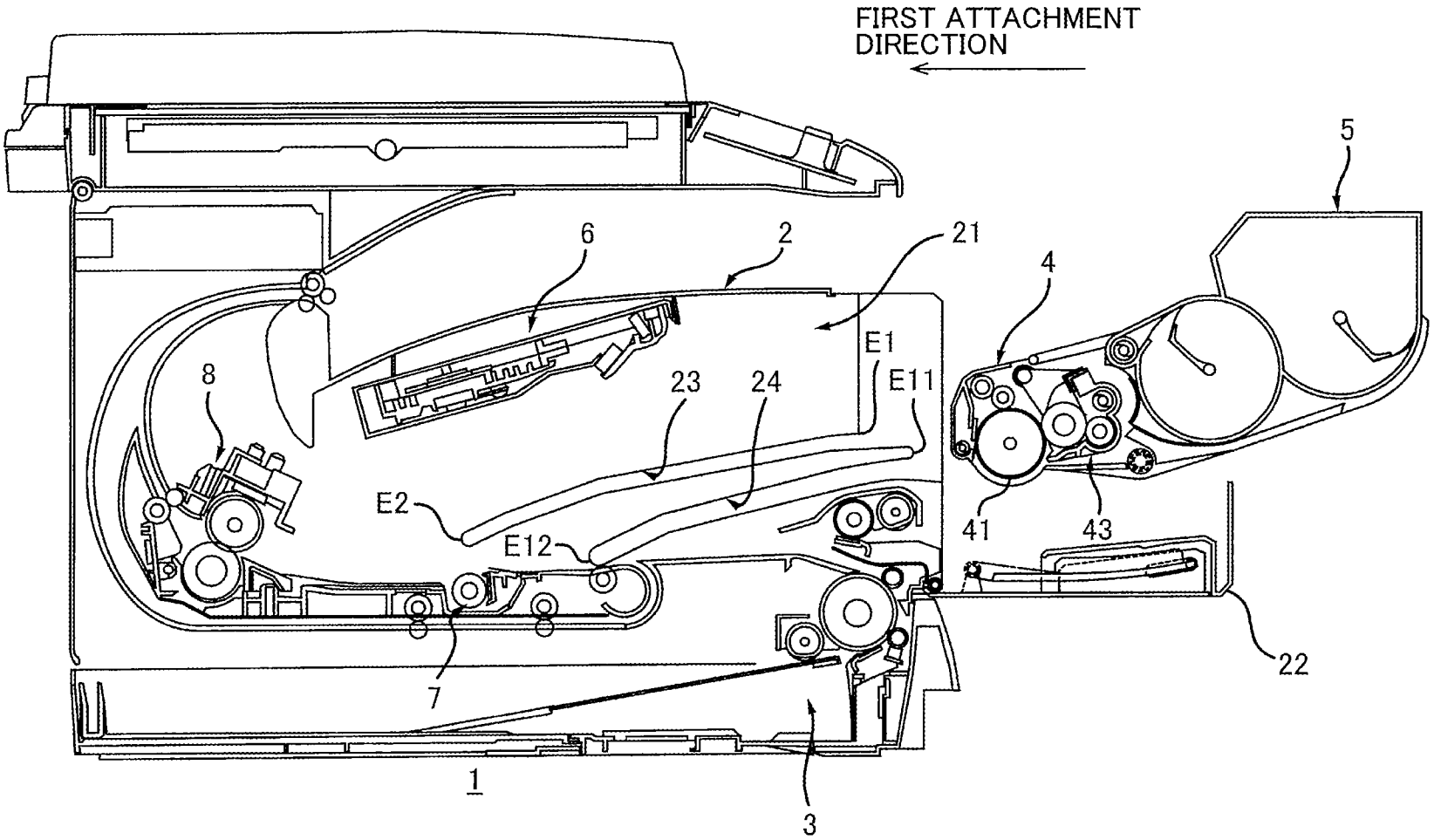
FIG. 2 is a diagram illustrating the image forming apparatus according to the embodiment, and illustrating a state where a drum cartridge to which a toner cartridge has been attached is detached from a main casing of the image forming apparatus.

As illustrated in FIG. 2, the main casing 2 is formed with an opening 21, and includes a cover 22, a guide 23, and a guide 24.

The opening 21 is formed in one side wall of the main casing 2 in a first attachment direction in which the drum cartridge 4 is moved when attached to the main casing 2. Specifically, the first attachment direction is also a direction in which the guide 23 extends.

The cover 22 is movable between a closed position (see FIG. 1) in which the cover 22 closes the opening 21 and an open position (see FIG. 2) in which the cover 22 opens the opening 21.

The guide 23 is configured to guide a protrusion 45A (described later) of the drum cartridge 4 (see FIG. 6). The guide 23 extends in the first attachment direction. The guide 23 has a first end portion E1 and a second end portion E2 in the first attachment direction. The first end portion E1 is interposed between the second end portion E2 and the cover 22 in the first attachment direction when the cover 22 is in the closed position. The second end portion E2 is spaced apart from the first end portion E1 in the first attachment direction. Although the guide 23 is a groove in the present embodiment, the guide 23 may be a rib instead.

The guide 24 is configured to guide a protrusion 46A (described later) of the drum cartridge 4 (see FIG. 6). The guide 24 extends in the first attachment direction. The guide 24 has a first end portion E11 and a second end portion E12 in the first attachment direction. The second end portion E12 is spaced apart from the first end portion E11 in the first attachment direction. When the cover 22 is in the closed position, the first end portion E11 is interposed between the second end portion E12 and the cover 22 in the first attachment direction. The guide 24 is a groove, but may be a rib.

<1.2. Sheet Cassette 3>

As illustrated in FIG. 1, the sheet cassette 3 can accommodate sheets S therein. The sheet S in the sheet cassette 3 is conveyed toward a photosensitive drum 41 (described later) of the drum cartridge 4.

<1.3. Drum Cartridge 4>

The drum cartridge 4 is attachable to the main casing 2. Specifically, in a state where the cover 22 is in the open position, the drum cartridge 4 is attachable to the main casing 2 via the opening 21 (see FIG. 2) in the first attachment direction. The drum cartridge 4 is fixed in position relative to the main casing 2 in a state where the drum cartridge 4 is attached to the main casing 2. Specifically, in the state where the drum cartridge 4 is attached to the main casing 2, the protrusion 45A and the protrusion 46A (see FIG. 6) are fitted into the second end portion E2 of the guide 23 and the second end portion E12 of the guide 24, respectively. In this state, the drum cartridge 4 is fixed in position relative to the main casing 2. The drum cartridge 4 is attachable to the main casing 2 with the toner cartridge 5 being attached to the drum cartridge 4. The drum cartridge 4 includes the photosensitive drum 41, a charging unit 42, and a developing unit 43.

<1.3.1. Photosensitive Drum 41>

The photosensitive drum 41 extends in a first direction. The first direction crosses the first attachment direction. Preferably, the first direction is orthogonal to the first attachment direction. The photosensitive drum 41 is rotatable about a drum axis A1 extending in the first direction.

<1.3.2. Charging Unit 42>

The charging unit 42 is in contact with a surface of the photosensitive drum 41 and configured to charge the surface of the photosensitive drum 41. In the present embodiment, the charging unit 42 is a charging roller. Note that the charging unit 42 may be a scorotron charger.

<1.3.3. Developing Unit 43>

The developing unit 43 is capable of supplying toner to the photosensitive drum 41. The developing unit 43 includes a developing roller 431, and a developing casing 432.

The developing roller 431 extends in the first direction. The developing roller 431 is rotatable about a developing axis A2 extending in the first direction. The developing roller 431 is capable of supplying toner in the developing casing 432 to the photosensitive drum 41. In the present embodiment, the developing roller 431 is in contact with the photosensitive drum 41. Alternatively, the developing roller 431 may be separated from the photosensitive drum 41 with a predetermined gap.

The developing casing 432 is configured to accommodate therein toner to be supplied to the photosensitive drum 41. The developing casing 432 supports the developing roller 431.

<1.4. Toner Cartridge 5>

The toner cartridge 5 is attachable to the main casing 2. In the present embodiment, the toner cartridge 5 is attachable to the drum cartridge 4 in a state where the drum cartridge 4 is detached from the main casing 2. The toner cartridge 5 is attached to the main casing 2 as the drum cartridge 4 having the toner cartridge 5 thereon is attached to the main casing 2. The toner cartridge 5 is positioned opposite to the photosensitive drum 41 with respect to the developing roller 431 in a state where the toner cartridge 5 is mounted on the drum cartridge 4. The toner cartridge 5 includes a toner casing 51.

The toner casing 51 is capable of accommodating therein toner to be supplied to the developing unit 43. The toner cartridge 5 is capable of supplying toner to the developing unit 43 in a state where the drum cartridge 4 and the toner cartridge 5 are mounted on the main casing 2.

<1.5. Exposure Unit 6>

The exposure unit 6 is configured to expose the surface of the photosensitive drum 41 charged by the charging unit 42 in the state where the drum cartridge 4 and the toner cartridge 5 are mounted on the main casing 2. Thereafter, the developing unit 43 is configured to supply toner to the surface of the photosensitive drum 41 which has been exposed by the exposure unit 6. In the present embodiment, the exposure unit 6 is a laser scan unit. The exposure unit 6 may instead be an LED head.

<1.6. Transfer Unit 7>

The transfer unit 7 is configured to transfer the toner carried on the photosensitive drum 41 onto a sheet S. Specifically, a sheet S fed from the sheet cassette 3 passes through a portion between the transfer unit 7 and the photosensitive drum 41. At this time, the toner on the photosensitive drum 41 is transferred onto the sheet S by the transfer unit 7. In the present embodiment, the transfer unit 7 is a transfer roller. The transfer unit 7 is in contact with the photosensitive drum 41 in the state where the drum cartridge 4 is attached to the main casing 2. However, the transfer unit 7 may be separated from the photosensitive drum 41 by a predetermined gap in the state where the drum cartridge 4 is mounted on the main casing 2.

<1.7. Fixing Unit 8>

The fixing unit 8 is configured to fix toner to a sheet S. In the present embodiment, the fixing unit 8 thermally fixes toner to a sheet S by applying heat and pressure to the sheet S onto which the toner has been transferred. The sheet S that has passed through the fixing unit 8 is then discharged onto an upper surface of the main casing 2.

<2. Details of Toner Cartridge 5>

A detailed configuration of the toner cartridge 5 will next be described with reference to FIGS. 3 to 5B, 11 and 12.

Figure 3:
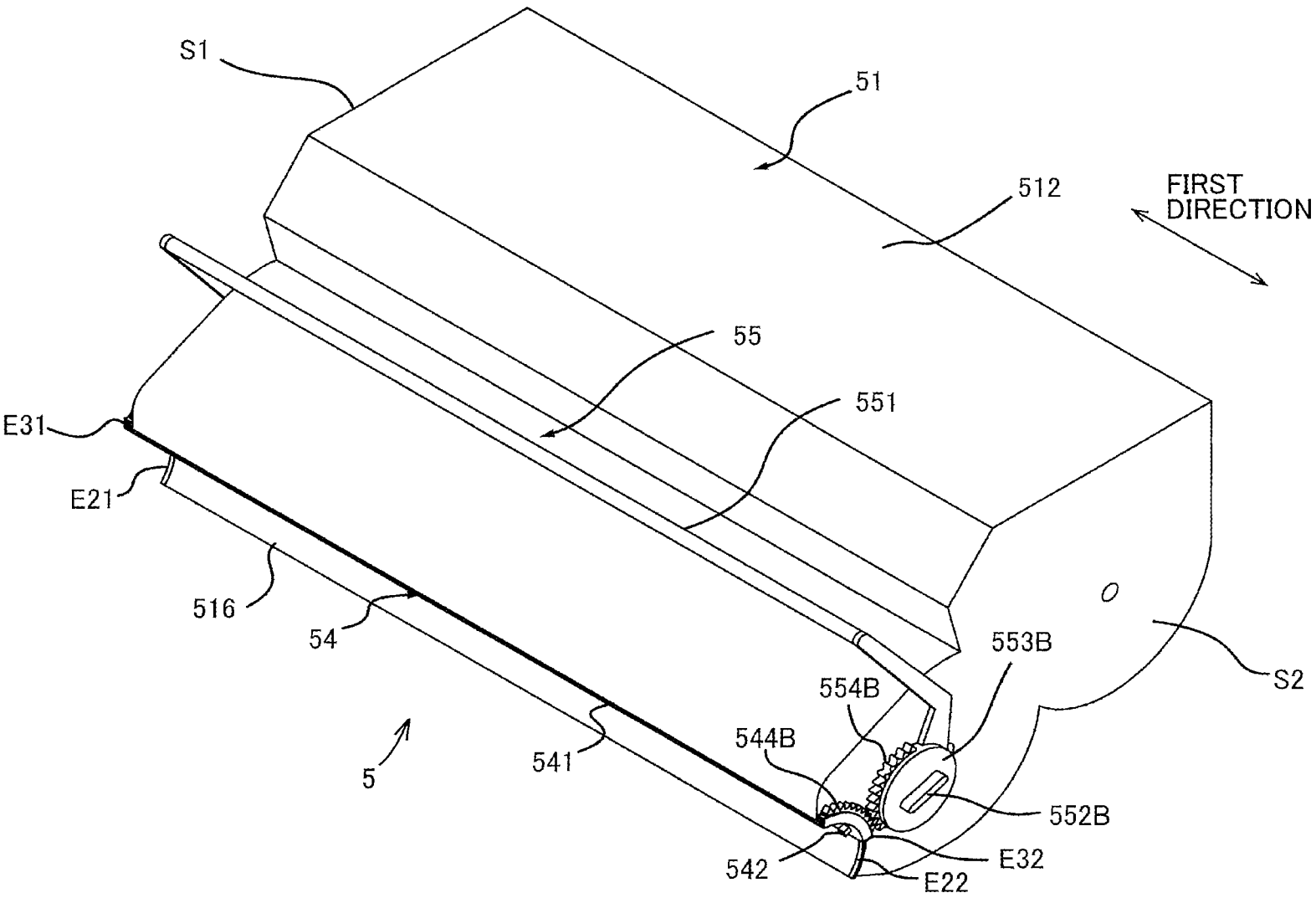
FIG. 3 is a perspective view of the toner cartridge in the image forming apparatus according to the embodiment.
Figure 4:
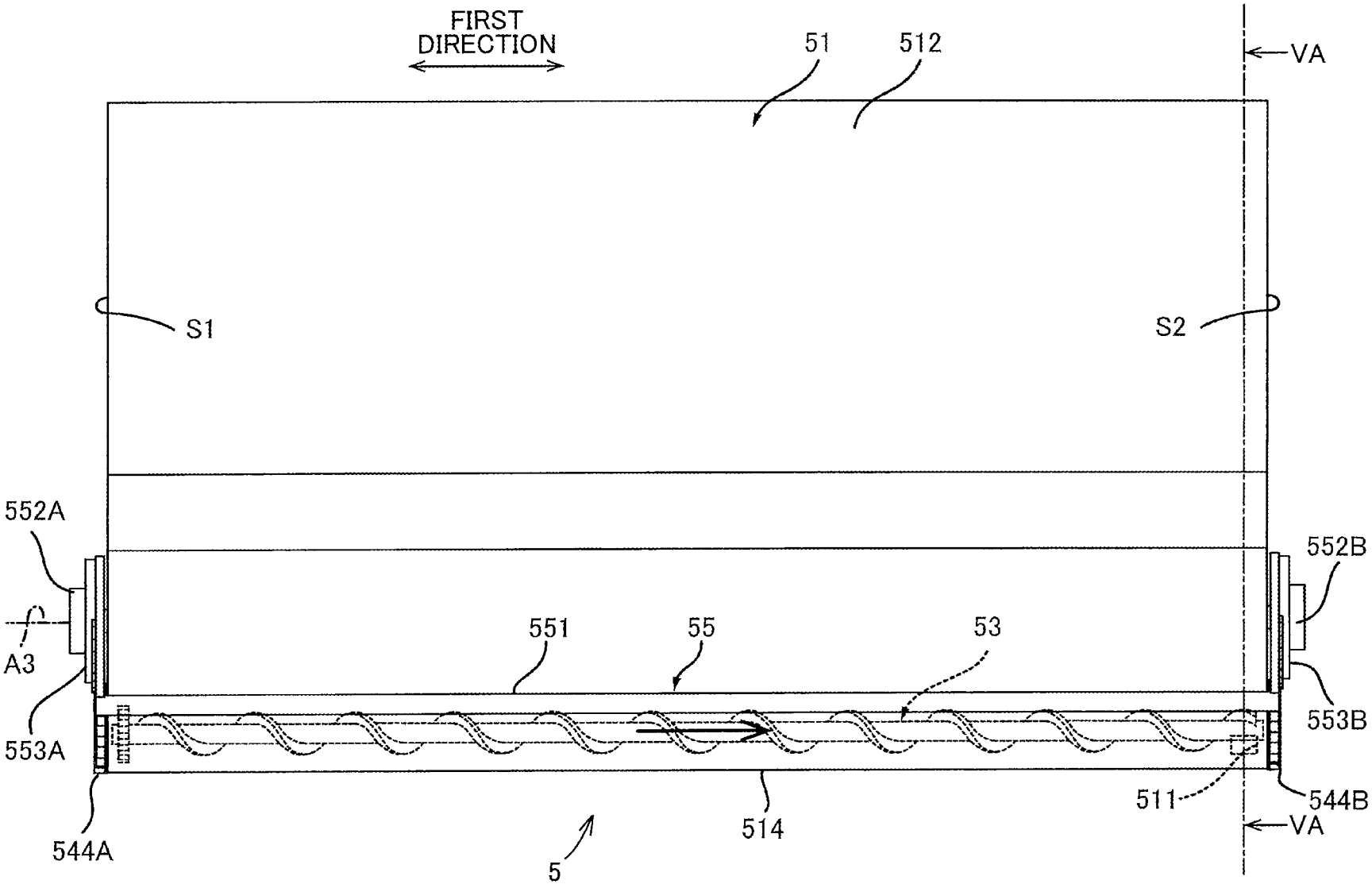
FIG. 4 is a plan view of the toner cartridge in the image forming apparatus according to the embodiment.

As illustrated in FIGS. 3 and 4, the toner cartridge 5 includes the toner casing 51 described above, an auger screw 53, a sealing member 52 (see FIG. 12), a toner shutter 54, and a handle 55.

<2.1. Details of Toner Casing 51>

The toner casing 51 extends in the first direction, and has one side surface S1 in the first direction and another side surface S2 in the first direction.

Figure 5A:
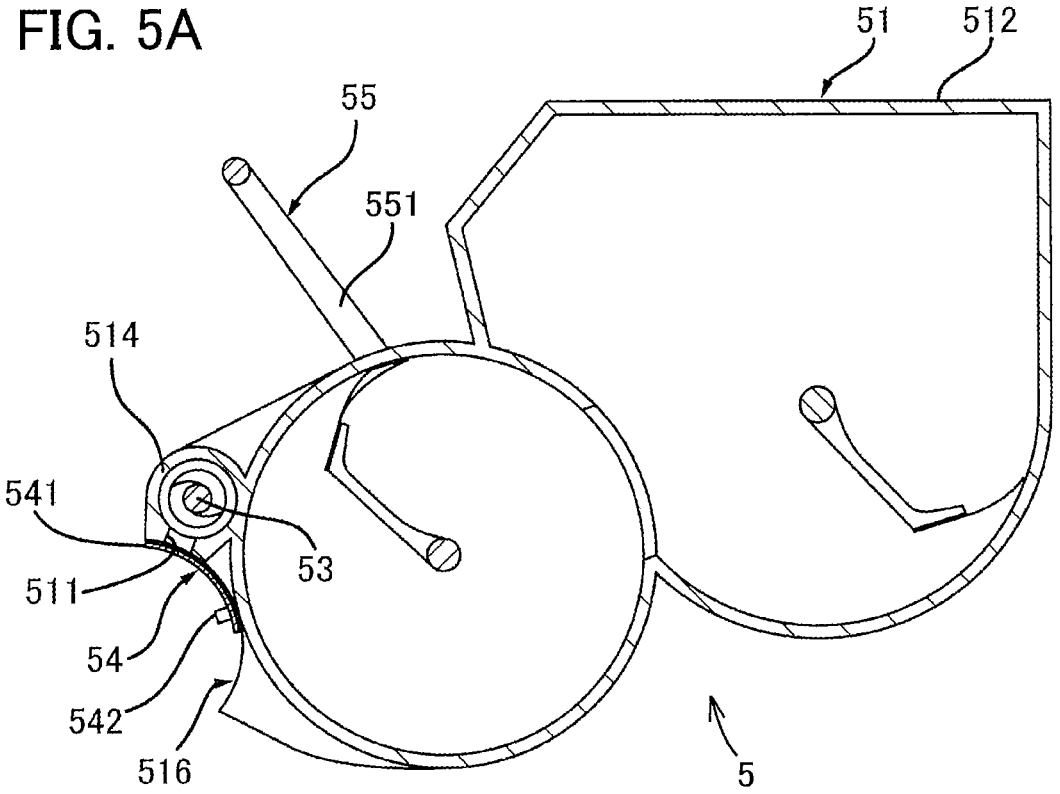
FIG. 5A is a cross-sectional view of the toner cartridge taken along a line VA-VA in FIG. 4.

As illustrated in FIG. 5A, the toner casing 51 includes a toner container 512, a receiving portion 516, and a toner conveyance unit 514.

<2.1.1. Toner Container 512>

The toner container 512 can accommodate toner therein.

<2.1.2. Receiving Portion 516>

The receiving portion 516 is configured to receive a developing shutter 437 (described later) through the toner shutter 54 in the state where the toner cartridge 5 is attached to the drum cartridge 4 (see FIG. 11). The receiving portion 516 is provided to extend along an outer circumferential surface of the developing shutter 437.

The receiving portion 516 and the toner container 512 are arranged in a direction crossing the first direction. The receiving portion 516 extends in a direction in which the toner shutter 54 is moved.

As illustrated in FIG. 3, the receiving portion 516 also extends in the first direction, and has one end portion E21 and another end portion E22 in the first direction. The one end portion E21 of the receiving portion 516 protrudes in the first direction from the side surface S1, while the other end portion E22 of the receiving portion 516 protrudes in the first direction from the side surface S2.

As illustrated in FIG. 5A, the receiving portion 516 is formed with a toner outlet 511. In other words, the toner casing 51 is formed with the toner outlet 511. The toner outlet 511 allows the toner accommodated in the toner casing 51 to be discharged to an outside of the toner casing 51 therethrough.

<2.1.3. Toner Conveyance Unit 514>

The toner in the toner casing 51 is conveyed from the toner container 512 toward the toner outlet 511 through the toner conveyance unit 514. The toner conveyance unit 514 has a hollow cylindrical shape and extends in the first direction. The toner conveyance unit 514 is positioned between the receiving portion 516 and the toner container 512, and is connected to the toner container 512 and the receiving portion 516. That is, the toner conveyance unit 514 has an inner space in communication with an inner space of the toner container 512 (see FIG. 1) and the toner outlet 511.

<2.2. Auger Screw 53>

The auger screw 53 is positioned inside the toner conveyance unit 514, and is configured to convey the toner in the toner conveyance unit 514 toward the toner outlet 511. The auger screw 53 extends in the first direction. The auger screw 53 is rotatable about an axis extending in the first direction.

<2.3. Toner Shutter 54>

Figure 11:
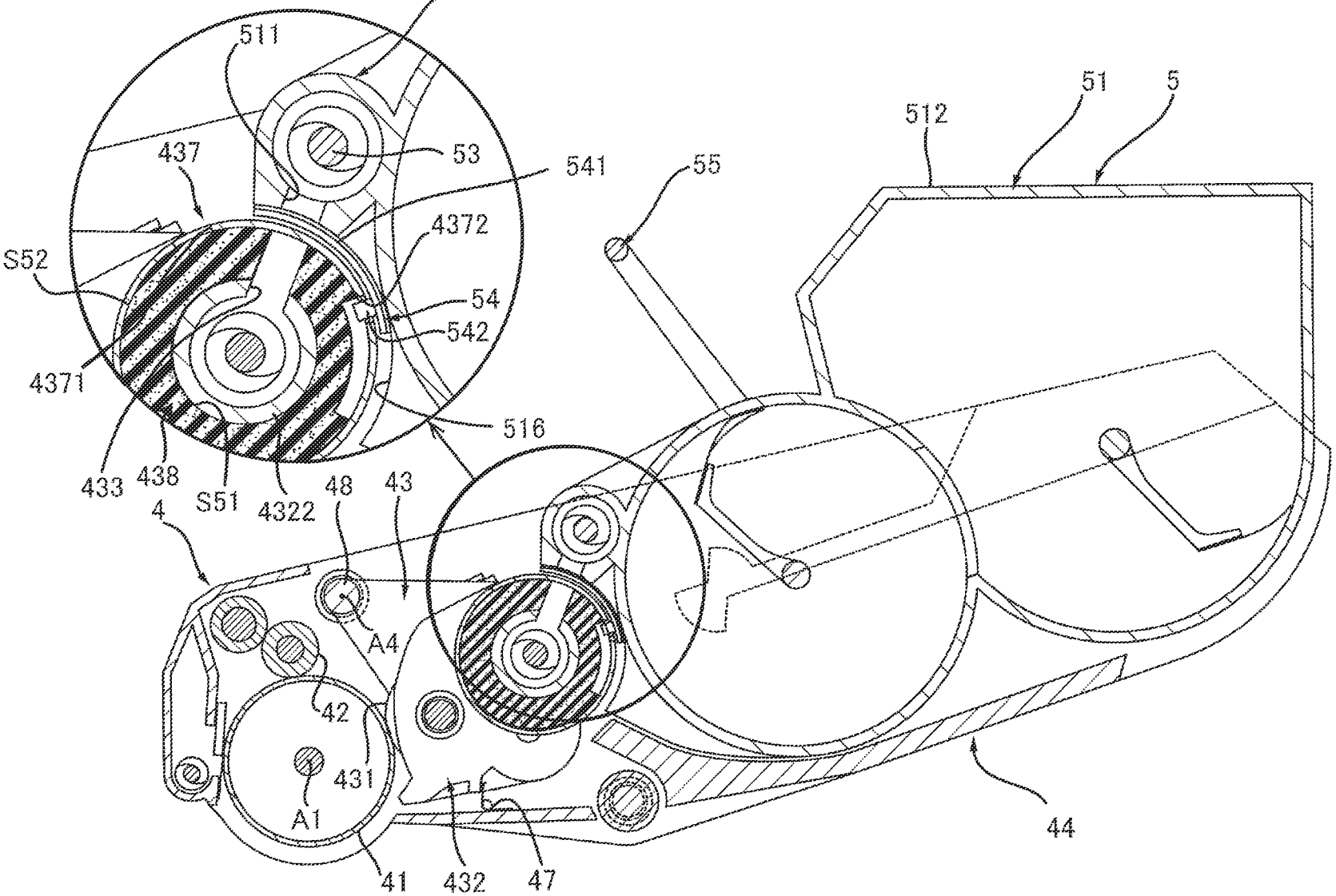
FIG. 11 is a view of the drum cartridge and toner cartridge attached thereto in the image forming apparatus according to the embodiment, and illustrating a state where the developing shutter is in its developing closed position and a toner shutter is in its toner closed position.
Figure 12:
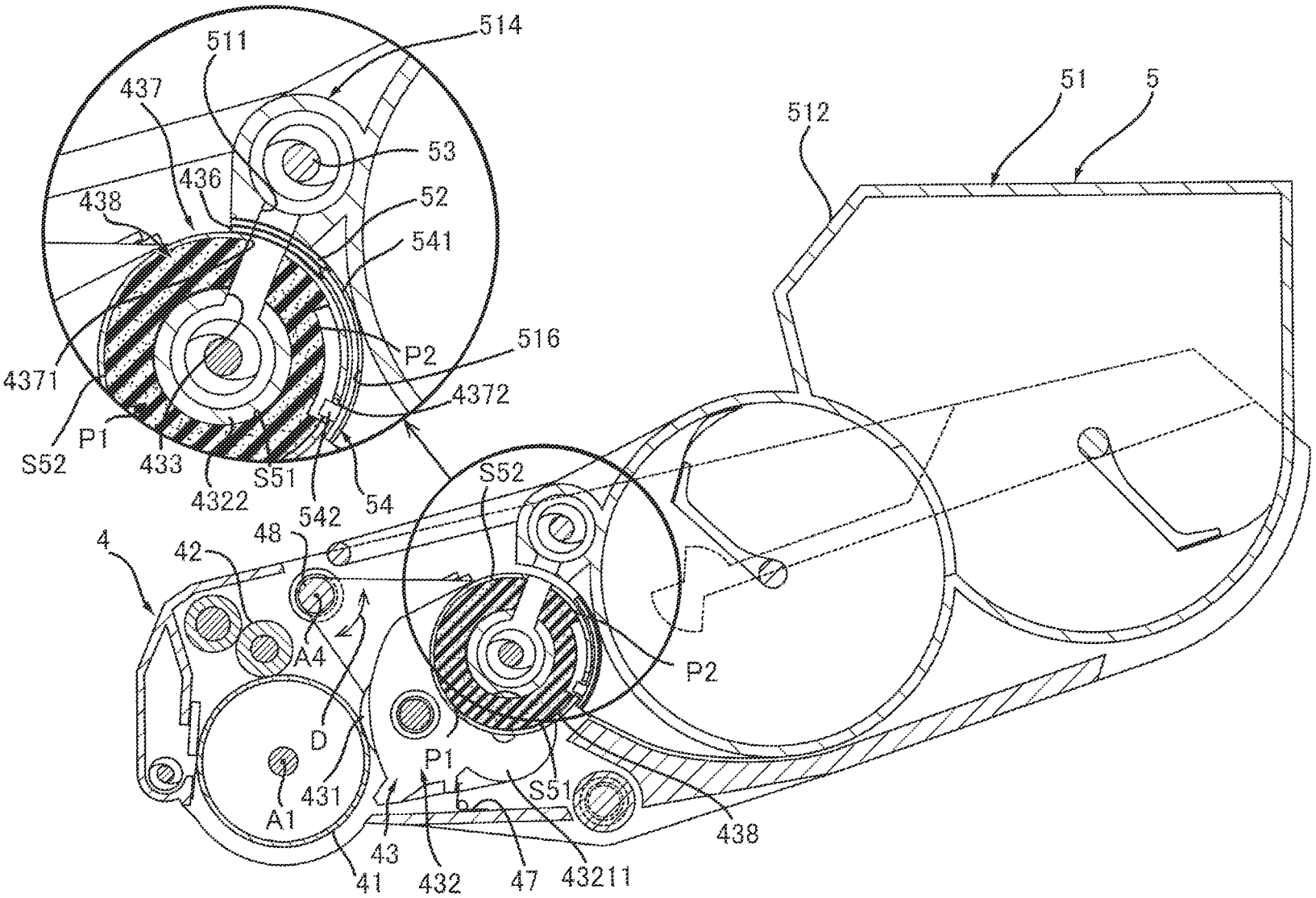
FIG. 12 is a view of the drum cartridge and toner cartridge attached thereto in the image forming apparatus according to the embodiment, and illustrating a state where the developing shutter is in its developing open position and the toner shutter is in its toner open position.

As illustrated in FIGS. 11 and 12, the toner shutter 54 is movable along the receiving portion 516 between a toner closed position (see FIG. 11) in which the toner shutter 54 closes the toner outlet 511 and a toner open position (see FIG. 12) in which the toner shutter 54 opens the toner outlet 511.

As illustrated in FIG. 3, the toner shutter 54 includes a toner shutter body 541 and a protrusion 542.

<2.3.1. Toner Shutter Body 541>

The toner shutter body 541 is provided to along the receiving portion 516. The toner shutter body 541 extends in a direction in which the toner shutter 54 is moved. The toner shutter body 541 is a plate-like member having a circular arc shape. The toner shutter body 541 also extends in the first direction, and has one end portion E31 and another end portion E32 in the first direction. During movement of the toner shutter 54 between the toner closed position (see FIG. 11) and the toner open position (see FIG. 12), the one end portion E31 and the other end portion E32 of the toner shutter body 541 are guided by the one end portion E21 and the other end E22 of the receiving portion 516, respectively.

The one end portion E31 of the toner shutter body 541 has a U-like shape. The one end portion E21 of the receiving portion 516 is fitted with the one end portion E31 of the toner shutter body 541. A shutter gear 544A is provided on the one end portion E31 of the toner shutter body 541 (see FIG. 4). The shutter gear 544A includes a plurality of gear teeth.

The other end portion E32 of the toner shutter body 541 has a U-like shape. The other end portion E22 of the receiving portion 516 is fitted into the other end portion E32 of the toner shutter body 541. A shutter gear 544B is provided on the other end portion E32 of the toner shutter body 541. The shutter gear 544B includes a plurality of gear teeth.

<2.3.2. Protrusion 542>

The protrusion 542 is positioned opposite to the receiving portion 516 with respect to the toner shutter body 541. The protrusion 542 is positioned between the one end portion E31 and the other end portion E32 of the toner shutter body 541 in the first direction. The protrusion 542 protrudes outward from the toner shutter body 541 in a radial direction of the toner shutter body 541. Note that the protrusion 542 may be attached to the toner shutter body 541.

<2.4. Sealing Member 52>

The sealing member 52 seals a portion between the receiving portion 516 and the toner shutter 54 in a state where the toner shutter 54 is in the toner closed position, as illustrated in FIG. 12. On the other hand, a portion of the sealing member 52 is interposed between the receiving portion 516 and the toner shutter 54 in a state where the toner shutter 54 is in the toner open position. With this configuration, the toner in the toner cartridge 5 is prevented from leaking from the portion between the receiving portion 516 and the toner shutter 54 by virtue of the sealing member 52. The sealing member 52 is positioned opposite to the toner conveyance unit 514 with respect to the receiving portion 516. The sealing member 52 may be affixed to the receiving portion 516 with an adhesive, for example. The sealing member 52 is provided to surround the toner outlet 511. In FIGS. 5A and 11, the sealing member 52 is omitted for simplicity.

<2.5. Handle 55>

As illustrated in FIG. 4, the handle 55 is configured to be operated by a user to move the toner shutter 54. The handle 55 includes a plate 553A, a protrusion 552A, a plate 553B, a protrusion 552B, and a handle body 551.

<2.5.1. Plate 553A>

Figure 9:
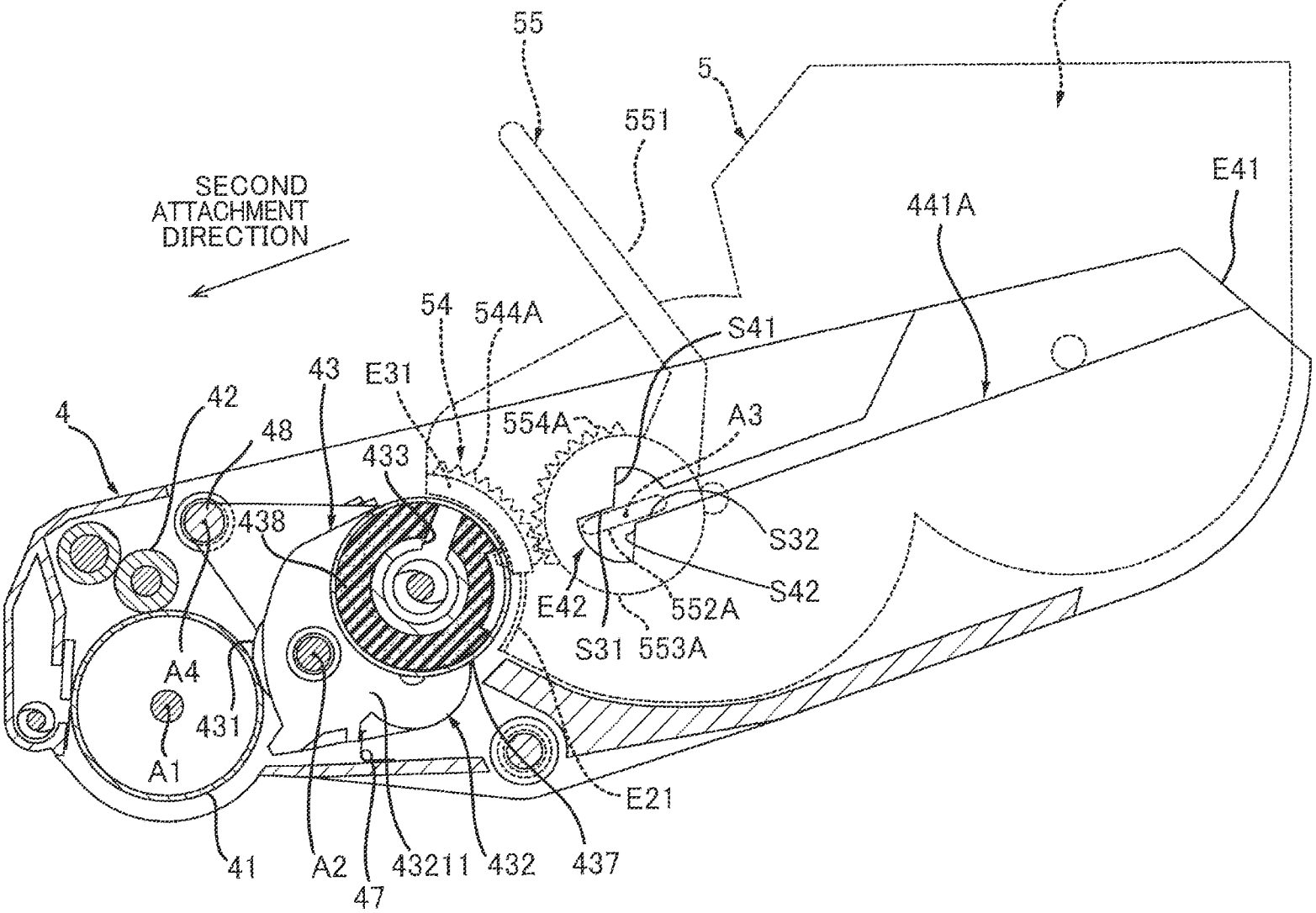
FIG. 9 is a view of the drum cartridge and toner cartridge attached thereto in the image forming apparatus according to the embodiment, and illustrating a state where the toner cartridge can be detached from the drum cartridge.

The plate 553A is disposed on the side surface S1, and is supported by the toner casing 51. As illustrated in FIG. 9, the plate 553A has a circular shape as viewed in the first direction. The plate 553A faces the one end portion E31 of the toner shutter body 541 in a radial direction of the plate 553A. The plate 553A is rotatable about an axis A3 extending in the first direction. A handle gear 554A is provided on a portion of a peripheral surface of the plate 553A. The handle gear 554A includes a plurality of gear teeth, and in meshing engagement with the shutter gear 544A.

<2.5.2. Protrusion 552A>

The protrusion 552A is provided on the plate 553A. The protrusion 552A is positioned opposite to the side surface S1 with respect to the plate 553A in the first direction (see FIG. 4). The protrusion 552A protrudes in the first direction from the plate 553A (see FIG. 4). The protrusion 552A may be attached to the plate 553A.

The protrusion 552A extends in the radial direction of the plate 553A. In the state where the toner cartridge 5 is attached to the drum cartridge 4, the protrusion 552A is fitted with in a guide 441A (described later) in the drum cartridge 4.

In a state where the toner cartridge 5 is attached to the drum cartridge 4 and the toner shutter 54 is in the toner closed position, the protrusion 552A extends in a second attachment direction. The second attachment direction denotes a direction in which the toner cartridge 5 is moved during an attachment process of the toner cartridge 5 to the drum cartridge 4. The second attachment direction crosses the first direction, and preferably, is orthogonal to the first direction. The protrusion 552A extends in a direction crossing both the first direction and the second attachment direction in a state where the toner cartridge 5 is attached to the drum cartridge 4 and the toner shutter 54 is in the toner open position (see FIG. 10).

<2.5.3. Plate 553B>

Figure 5B:
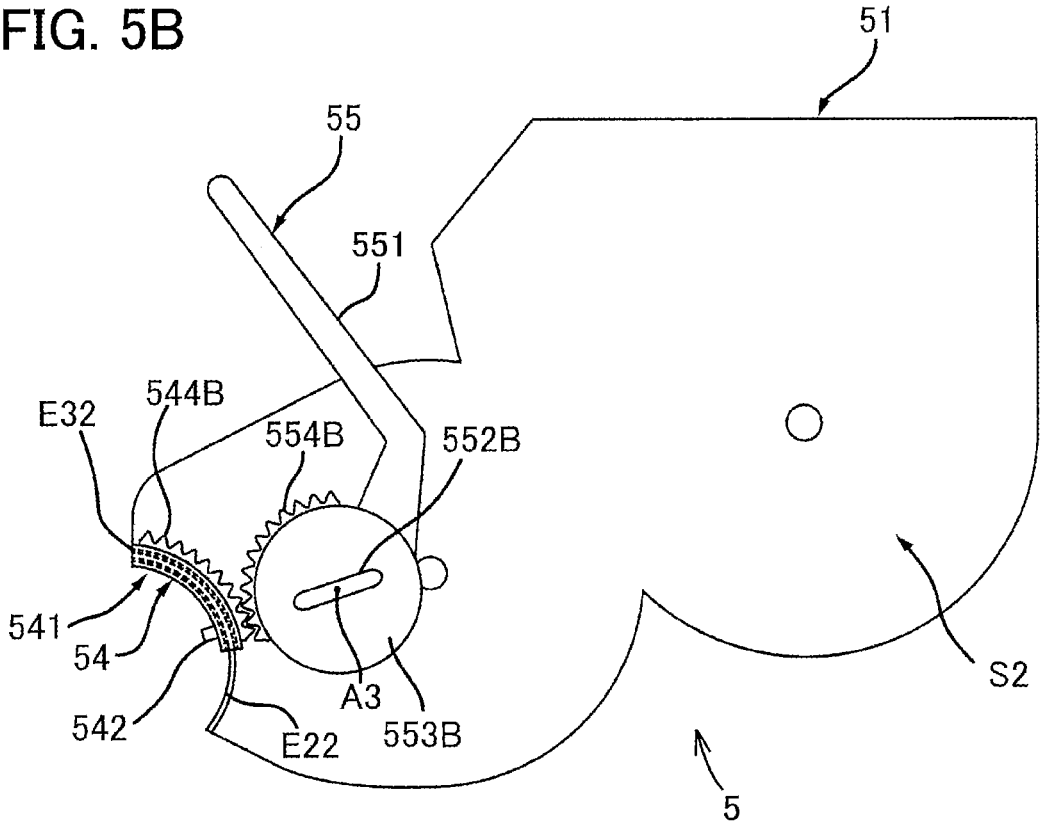
FIG. 5B is a side view of the toner cartridge in the image forming apparatus according to the embodiment.

The plate 553B will be described as similarly to the plate 553A. As illustrated in FIG. 5B, the plate 553B is disposed on the side surface S2. The plate 553B faces the other end portion E32 of the toner shutter body 541 in a radial direction of the plate 553B. A handle gear 554B is provided on a portion of a peripheral surface of the plate 553B. The handle gear 554B includes a plurality of gear teeth, and is in meshing engagement with the shutter gear 544B.

<2.5.4. Protrusion 552B>

The protrusion 552B is provided on the plate 553B. The protrusion 552B is positioned opposite to the side surface S2 with respect to the plate 553B in the first direction. The protrusion 552B protrudes in the first direction from the plate 553B. The protrusion 552B may be attached to the plate 553B. The protrusion 552B has a shape identical to that of the protrusion 552A. The protrusion 552B is fitted with a guide 441B (described later) in the drum cartridge 4 in the state where the toner cartridge 5 is attached to the drum cartridge 4 (see FIG. 6).

<2.5.5. Handle Body 551>

As illustrated in FIG. 3, the handle body 551 has a U-like shape. The handle body 551 has a first end and a second end. The first end of the handle body 551 is connected to the plate 553A (see FIG. 9), while the second end of the handle body 551 is connected to the plate 553B (see FIG. 5B).

As the user operates the handle body 551, each of the plate 553A and the plate 553B rotates. Then, the handle gears 554A and 554B and the shutter gears 544A and 544B transmit a driving force applied by the user to the toner shutter body 541, thereby moving the toner shutter 54 between the toner closed position (see FIG. 11) and the toner open position (see FIG. 12). In this way, the user can move the toner shutter 54 easily by operating the handle 55.

<3. Details of Drum Cartridge 4>

Next, the detailed configuration of the drum cartridge 4 will be described with reference to FIGS. 6 to 12.

Figure 6:
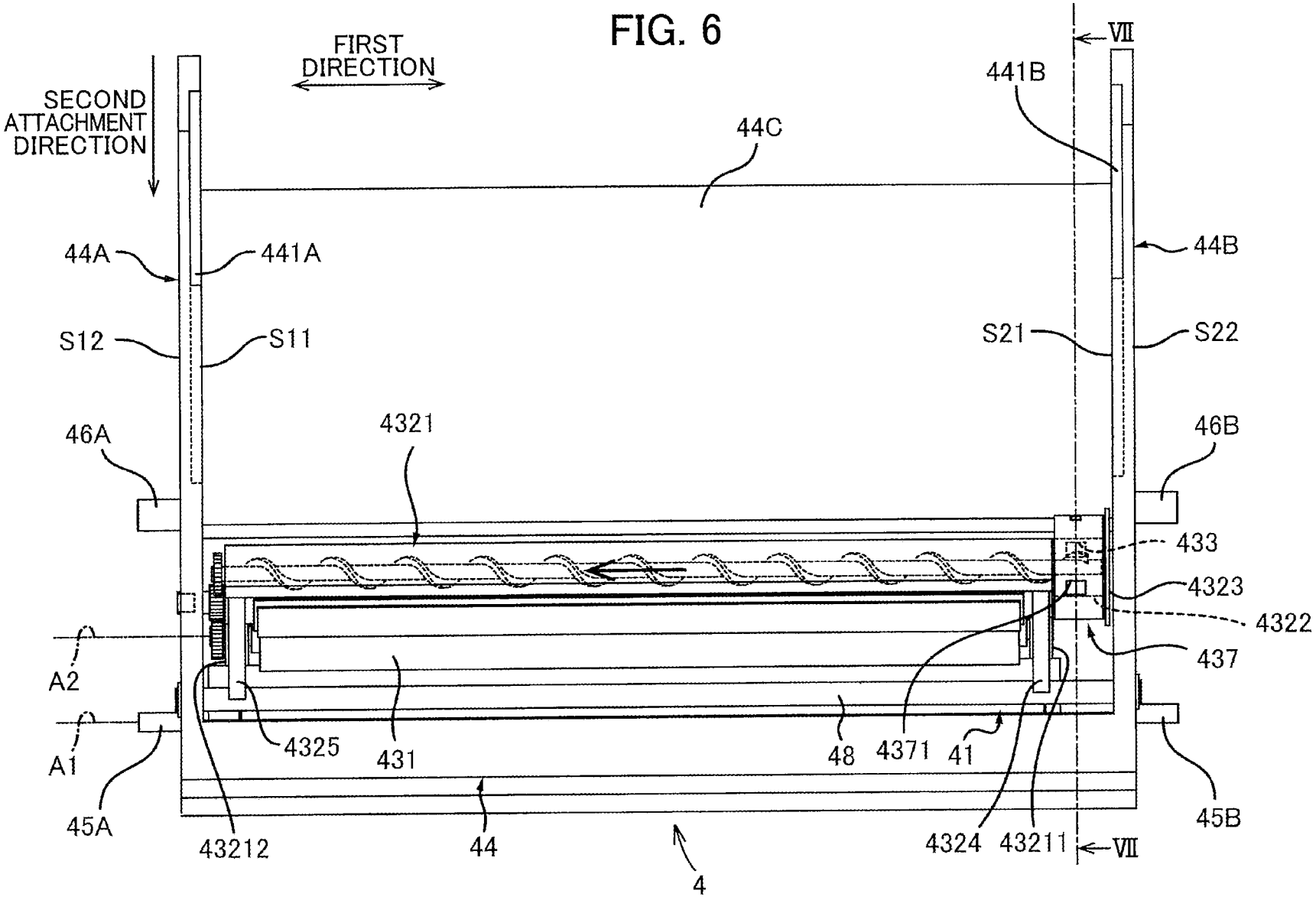
FIG. 6 is a plan view of the drum cartridge in the image forming apparatus according to the embodiment.
Figure 7:
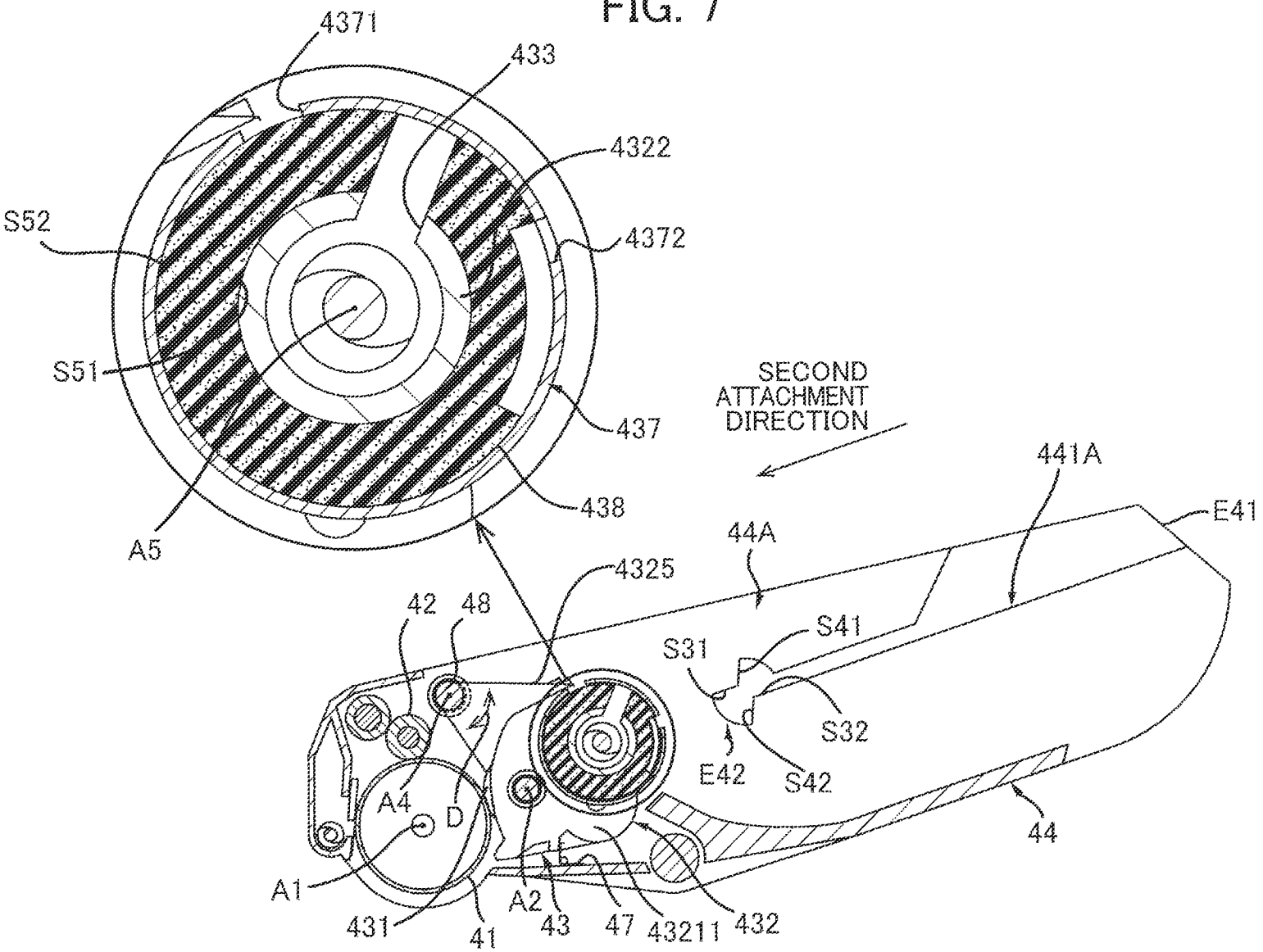
FIG. 7 is a cross-sectional view of the drum cartridge taken along a line VII-VII in FIG. 6, and illustrating a state where a developing shutter is in its developing closed position.

As illustrated in FIG. 6, the drum cartridge 4 includes the photosensitive drum 41, the charging unit 42 (see FIG. 7), the developing unit 43 those are described above, a drum frame 44, two protrusions 45A and 45B, two protrusions 46A and 46B, a shaft 48, and a pressing member 47 (see FIG. 7).

<3.1. Drum Frame 44>

The drum frame 44 includes a side plate 44A on one side in the first direction, a side plate 44B on the other side in the first direction, and a bottom plate 44C.

<3.1.1. Side Plate 44A>

The side plate 44A constitutes one end in the first direction of the drum frame 44. The side plate 44A extends in the second attachment direction. The side plate 44A has an inner surface S11 and an outer surface S12 in the first direction. The inner surface S11 is provided between the outer surface S12 and the side plate 44B in the first direction. The side plate 44A is formed with the guide 441A.

As illustrated in FIG. 7, the guide 441A is formed at a position opposite to the photosensitive drum 41 with respect to the developing unit 43. The guide 441A extends in the second attachment direction. The guide 441A is a groove and configured to guide the protrusion 552A (see FIG. 4) during the attachment process of toner cartridge 5 to the drum cartridge 4. The guide 441A may be a rib.

The guide 441A has a first end portion E41 and a second end portion E42 in the second attachment direction. The first end portion E41 is positioned opposite to the developing unit 43 with respect to the second end portion E42 in the second attachment direction. The second end portion E42 is spaced apart from the first end portion E41 in the second attachment direction.

As illustrated in FIG. 9, in the state where the toner cartridge 5 is attached to the drum cartridge 4, the protrusion 552A is positioned at the second end portion E42 of the guide 441A. In this state, the protrusion 552A is fitted with the second end portion E42 of the guide 441A, whereby the toner casing 51 of the toner cartridge 5 is fixed in position relative to the drum cartridge 4. In an attached state of the toner cartridge 5 to the drum cartridge 4, the second end portion E42 allows the protrusion 552A to be rotated about the axis A3 (see FIG. 10). The second end portion E42 has a first guide surface S31, a second guide surface S32, a first lock surface S41, and a second lock surface S42.

Each of the first guide surface S31 and the second guide surface S32 extends in the second attachment direction. In the state where the toner cartridge 5 is attached to the drum cartridge 4, the first guide surface S31 is positioned opposite to the second guide surface S32 with respect to the axis A3. In the state where the toner cartridge 5 is attached to the drum cartridge 4 and the toner shutter 54 is in the toner closed position, the protrusion 552A extends in the second attachment direction, as described above. In this state, the protrusion 552A is positioned between the first guide surface S31 and the second guide surface S32, and faces both the first guide surface S31 and the second guide surface S32 in a direction crossing the second attachment direction.

With the above configuration, the toner cartridge 5 is allowed to be detached from the drum cartridge 4 along the guide 441A in the state where the toner cartridge 5 is attached to the drum cartridge 4 and the toner shutter 54 is in the toner closed position.

Each of the first lock surface S41 and the second lock surface S42 extends in the direction crossing the second attachment direction. The first lock surface S41 is positioned opposite to the second lock surface S42 with respect to the axis A3 in the attached state of the toner cartridge 5 to the drum cartridge 4. The first lock surface S41 is continuous with the first guide surface S31, and the second lock surface S42 is continuous with the second guide surface S32.

Figure 10:
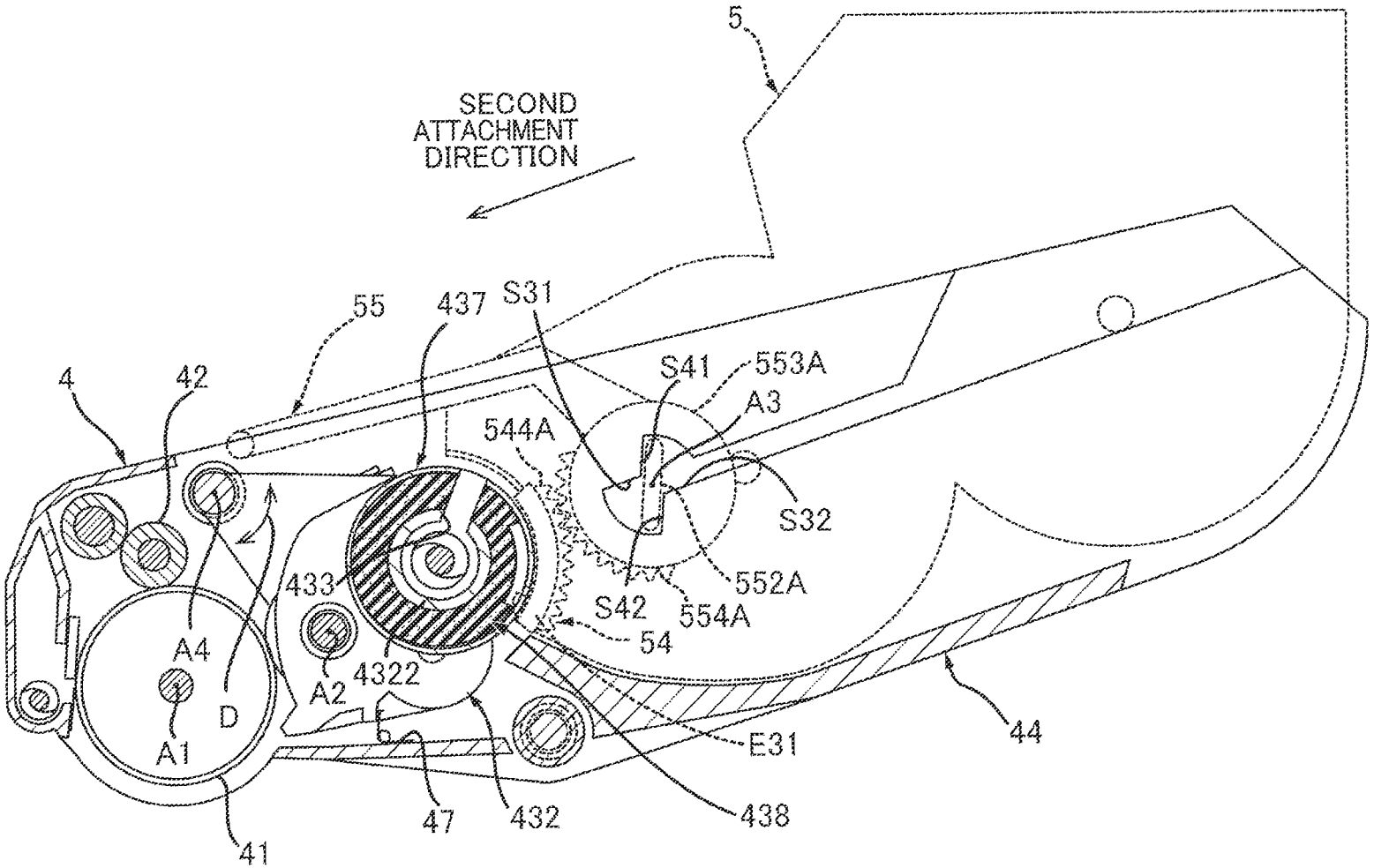
FIG. 10 is a view of the drum cartridge and toner cartridge attached thereto in the image forming apparatus according to the embodiment, and illustrating a state where the toner cartridge is locked relative to the drum cartridge.

As illustrated in FIG. 10, in the state where the toner cartridge 5 is attached to the drum cartridge 4 and the toner shutter 54 is in the toner open position, the protrusion 552A extending in the direction crossing the second attachment direction is positioned between the first lock surface S41 and the second lock surface S42, and faces the first lock surface S41 and the second lock surface S42 in the second attachment direction.

Accordingly, the toner cartridge 5 is locked relative to the drum cartridge 4 in a state where the toner cartridge 5 is attached to the drum cartridge 4, the developing shutter 437 (described later) is in its developing open position, and the toner shutter 54 is in the toner open position.

"The toner cartridge 5 is locked relative to the drum cartridge 4" denotes that the toner cartridge 5 is fixed to the drum frame 44 in the second attachment direction so as not to be movable in the second attachment direction relative to the drum cartridge 4.

The above configuration can prevent detachment of the toner cartridge 5 from the drum cartridge 4 in the state where the developing shutter 437 is in the developing open position and the toner shutter 54 is in the toner open position.

<3.1.2. Side Plate 44B>

As illustrated in FIG. 6, the side plate 44B constitutes another end in the first direction of the drum frame 44. The side plate 44B is spaced apart from the side plate 44A in the first direction. The side plate 44B extends in the second attachment direction. The side plate 44B has an inner surface S21 and an outer surface S22 in the first direction. The inner surface S21 is provided at a position between the outer surface S22 and the side plate 44A in the first direction. The side plate 44B has the guide 441B.

The guide 441B has a shape identical to that of the guide 441A. The guide 441B is configured to guide the protrusion 552B of the toner cartridge 5 (see FIG. 4) during the attachment process of the toner cartridge 5 to the drum cartridge 4.

<3.1.3. Bottom Plate 44C>

The bottom plate 44C is positioned between the side plate 44A and the side plate 44B in the first direction. The bottom plate 44C extends in the first direction. The bottom plate 44C has one end in the first direction connected to the side plate 44A, and has another end in the first direction connected to the side plate 44B.

<3.2. Protrusions 45A, 45B, 46A, and 46B>

The protrusion 45A is provided on the outer surface S12 of the side plate 44A. The protrusion 45A has a columnar shape and extends in the first direction. In the present embodiment, the protrusion 45A serves as one end of a shaft that supports the photosensitive drum 41. That is, the protrusion 45A extends along the drum axis A1.

The protrusion 45B is provided on the outer surface S22 of the side plate 44B. The protrusion 45B has a columnar shape and extends in the first direction. Since the protrusion 45B serves as another end of the shaft for supporting the photosensitive drum 41, the protrusion 45B extends along the drum axis A1.

The protrusion 46A is disposed on the outer surface S12 of the side plate 44A. The protrusion 46A is positioned to be spaced apart from the protrusion 45A in a second direction D (see FIGS. 10 and 12; described later). The protrusion 46A has a columnar shape and extends in the first direction.

The protrusion 46B is provided on the outer surface S22 of the side plate 44B. The protrusion 46B is spaced apart from the protrusion 45B in the second direction D. The protrusion 46B extends in the first direction and has a columnar shape.

<3.3. Shaft 48>

The shaft 48 has a columnar shape and extends in the first direction. The shaft 48 is supported by the side plate 44A and the side plate 44B so as to be rotatable about an axis A4 illustrated in FIG. 7. The axis A4 extends in the first direction. The shaft 48 is positioned opposite to the first end portion E41 with respect to the second end portion E42 of the guide 441A in the second attachment direction.

<3.4. Pressing Member 47>

The pressing member 47 is a member configured to press the developing unit 43 toward the photosensitive drum 41. In the present embodiment, the pressing member 47 is a torsion spring. The pressing member 47 may instead be a compression coil spring.

<3.5. Details of Developing Unit 43>

As illustrated in FIGS. 6, 7 and 12, in addition to the above-described developing roller 431 and developing casing 432, the developing unit 43 further includes the developing shutter 437, a sealing member 436, and a cushion member 438.

<3.5.1. Details of Developing Casing 432>

The developing casing 432 is positioned between the side plate 44A and the side plate 44B in the first direction. The developing casing 432 extends in the first direction.

The developing casing 432 includes an accommodating portion 4321, a tubular portion 4322 (see FIG. 7), a flange portion 4323, two connecting portions 4324 and 4325.

<3.5.1.1. Accommodating Portion 4321>

The accommodating portion 4321 accommodates the developing roller 431 therein. The accommodating portion 4321 includes a side wall 43211 on one side in the first direction of the developing casing 432, and a side wall 43212 on another side in the first direction of the developing casing 432. In other words, the developing casing 432 includes the side wall 43211 and the side wall 43212. The side wall 43211 is spaced apart from the side wall 43212 in the first direction. The side wall 43211 and the side wall 43212 rotatably support the developing roller 431.

<3.5.1.2. Tubular Portion 4322>

The tubular portion 4322 constitutes one end portion in the first direction of the developing casing 432. The tubular portion 4322 is positioned opposite to the side wall 43212 with respect to the side wall 43211 in the first direction. Also, the tubular portion 4322 is positioned between the side wall 43211 and the side plate 44B in the first direction. In other words, the tubular portion 4322 is positioned at the side wall 43211. The tubular portion 4322 extends in the first direction. The tubular portion 4322 has a hollow cylindrical shape.

As illustrated in FIG. 7, the tubular portion 4322 is formed with a toner inlet 433. Put another way, the developing casing 432 is formed with the toner inlet 433. The toner inlet 433 allows the toner discharged from the toner cartridge 5 through the toner outlet 511 to enter the developing casing 432 therethrough in the state where the drum cartridge 4 and the toner cartridge 5 are mounted on the main casing 2 (see FIG. 12).

<3.5.1.3. Flange Portion 4323>

As illustrated in FIG. 6, the flange portion 4323 is provided on an outer circumferential surface of the tubular portion 4322. The flange portion 4323 protrudes outward from the outer circumferential surface of the tubular portion 4322 in a radial direction of the tubular portion 4322. The flange portion 4323 is positioned away from the side wall 43211 in the first direction.

<3.5.1.4. Two Connecting Portions 4324 and 4325>

The connecting portion 4324 connects the side wall 43211 to the shaft 48. The connecting portion 4325 is spaced apart from the connecting portion 4324 in the first direction. The connecting portion 4325 connects the side wall 43212 to the shaft 48. With this configuration, the developing casing 432 is pivotally movable about the axis A4 of the shaft 48, as illustrated in FIG. 10. In other words, the developing casing 432 is movable relative to the photosensitive drum 41 in the second direction D in which the developing casing 432 is pivotally moved. The second direction D crosses the first direction.

<3.5.2. Developing Shutter 437>

Figure 8:
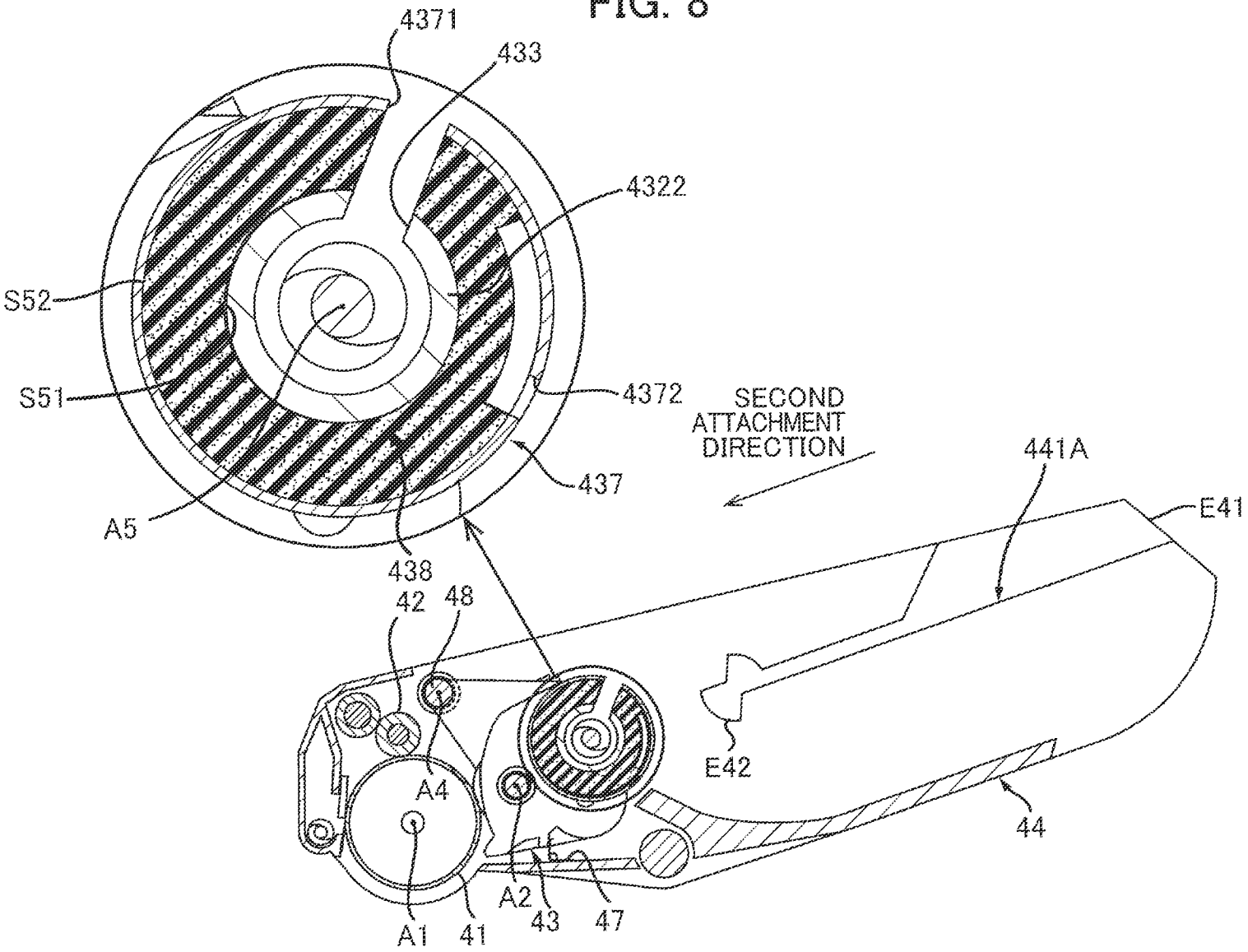
FIG. 8 is a cross-sectional view of the drum cartridge taken along the line VII-VII in FIG. 6, and illustrating a state where the developing shutter is in its developing open position.

The developing shutter 437 is movable between a developing closed position (see FIG. 7) and the developing open position (see FIG. 8). Specifically, the developing shutter 437 is pivotally movable between the developing closed position and the developing open position about an axis A5 extending in the first direction. As illustrated in FIG. 7, the developing shutter 437 closes the toner inlet 433 when the developing shutter 437 is in the developing closed position. As illustrated in FIG. 8, the toner inlet 433 is open when the developing shutter 437 is in the developing open position.

As illustrated in FIG. 6, the developing shutter 437 extends in the first direction. The developing shutter 437 has a hollow cylindrical shape. Accordingly, the developing shutter 437 is movable between the developing closed position and the developing open position by rotation thereof, thereby reducing a space required for the developing shutter 437 to be moved.

As illustrated in FIGS. 7 and 8, the developing shutter 437 is positioned outside the tubular portion 4322. In other words, the tubular portion 4322 is disposed inside the developing shutter 437. The tubular portion 4322 is spaced apart from the developing shutter 437 in a radial direction of the developing shutter 437. Further, the developing shutter 437 is positioned between the side wall 43211 and the flange portion 4323 in the first direction. Therefore, the developing shutter 437 can be prevented from moving in the first direction, which may cause unintentional detachment of the developing shutter 437 from the tubular portion 4322. The developing shutter 437 is formed with a developing shutter opening 4371 and a hole 4372.

<3.5.2.1. Developing Shutter Opening 4371>

The developing shutter opening 4371 is away from the toner inlet 433 when the developing shutter 437 is in the developing closed position (see FIG. 7). The developing shutter opening 4371 is not in communication with the toner inlet 433 at all when the developing shutter 437 is in the developing closed position.

As illustrated in FIG. 8, when the developing shutter 437 is in the developing open position, the developing shutter opening 4371 has at least a portion in communication with the toner inlet 433.

As illustrated in FIG. 12, the developing shutter 437 is fitted with the receiving portion 516 of the toner cartridge 5 in the attached state of the toner cartridge 5 to the drum cartridge 4. The toner outlet 511 is in communication with the developing shutter opening 4371 in a state where the drum cartridge 4 and the toner cartridge 5 are attached to the main casing 2, the developing shutter 437 is in the developing open position, and the toner shutter 54 is in the toner open position. Thus, the toner discharged from the toner cartridge 5 through the toner outlet 511 is allowed to enter the tubular portion 4322 of the developing casing 432 through the developing shutter opening 4371 and the toner inlet 433.

In the state where the drum cartridge 4 and the toner cartridge 5 are attached to the main casing 2, the toner outlet 511 is positioned higher than the toner inlet 433. With this arrangement, the toner in the toner cartridge 5 can be supplied through the toner outlet 511 to the developing unit 43 by virtue of the gravitational force. Thereafter, the toner discharged through the toner outlet 511 enters the developing casing 432 through the developing shutter opening 4371 and the toner inlet 433.

<3.5.2.2. Hole 4372>

The hole 4372 is positioned away from the developing shutter opening 4371 in a circumferential direction of the developing shutter 437. In the state where the drum cartridge 4 and the toner cartridge 5 are attached to the main casing 2, the hole 4372 receives the protrusion 542 of the toner shutter 54. Accordingly, the developing shutter 437 is in engagement with the toner cartridge 5 in the state where the drum cartridge 4 and the toner cartridge 5 are attached to the main casing 2. Specifically, in this state, the developing shutter 437 is in engagement with the toner shutter 54. By virtue of this engagement between the developing shutter 437 and the toner shutter 54 of the toner cartridge 5, the developing shutter 437 can be fixed to the toner cartridge 5. Also with this engagement, the developing shutter 437 is movable between the developing open position and the developing closed position in accordance with the movement of the toner shutter 54 between the toner open position and the toner closed position.

"The developing shutter 437 is fixed to the toner cartridge 5" denotes that movement of the developing shutter 437 relative to the toner cartridge 5 in the second direction D is prevented even when the developing casing 432 is moved relative to the photosensitive drum 41 in the second direction D.

Accordingly, even when the developing casing 432 is moved relative to the photosensitive drum 41 in the second direction D while the drum cartridge 4 and the toner cartridge 5 are attached to the main casing 2, the developing shutter 437 is in the developing open position, and the toner shutter 54 is in the toner open position, deviation in position of the developing shutter opening 4371 relative to the toner outlet 511 in the second direction D can be restrained.

Consequently, in a configuration in which toner is supplied from the toner cartridge 5 to the developing casing 432 that is movable relative to the photosensitive drum 41, leakage of toner supplied from the toner cartridge 5 to the developing casing 432 can be more reliably suppressed.

The developing shutter 437 is pivotally movable together with the toner shutter 54 about the axis A5 in a state where the developing shutter 437 is fixed to the toner cartridge 5.

<3.5.3. Sealing Member 436>

As illustrated in FIG. 12, the sealing member 436 seals a portion between the developing shutter 437 and the receiving portion 516 in cooperation with the sealing member 52 in the state where the toner shutter 54 is in the toner open position and the developing shutter 437 is in the developing open position. The sealing member 436 is provided on the outer circumferential surface of the developing shutter 437. The sealing member 436 may be affixed to the developing shutter 437 with an adhesive, for example. The sealing member 436 surrounds the developing shutter opening 4371. In FIGS. 7 to 11, the sealing member 436 is omitted for simplicity.

<3.6. Cushion Member 438>

The cushion member 438 is positioned between the tubular portion 4322 of the developing casing 432 and the developing shutter 437.

<3.6.1. Material of Cushion Member 438>

The cushion member 438 is made of an elastic material. In the present embodiment, the cushion member 438 is made of sponge. The cushion member 438 is positioned between the tubular portion 4322 and the developing shutter 437 while the cushion member 438 is being slightly compressed.

When the developing casing 432 is moved relative to the photosensitive drum 41 in the state where the drum cartridge 4 and the toner cartridge 5 are attached to the main casing 2, the developing shutter 437 is in the developing open position, and the toner shutter 54 is in the toner open position, the tubular portion 4322 of the developing casing 432 is moved relative to the developing shutter 437 while the developing shutter 437 is fixed to the toner cartridge 5. At this time, the cushion member 438 comes into elastic deformation.

Specifically, the tubular portion 4322 is moved in a direction away from the photosensitive drum 41 in accordance with movement of the developing casing 432 in the direction away from the photosensitive drum 41. Meanwhile, the developing shutter 437 is fixed to the toner cartridge 5 and thus is immovable.

In this state, a portion P1 of the cushion member 438 that is positioned between the photosensitive drum 41 and the tubular portion 4322 is restored from its compressed state and fills a space between the developing shutter 437 and the tubular portion 4322 generated due to movement of the developing casing 432. Meanwhile, a portion P2 of the cushion member 438 that is positioned opposite to the photosensitive drum 41 with respect to the tubular portion 4322 becomes more compressed between the developing shutter 437 and the tubular portion 4322.

In the meantime, when the developing casing 432 is moved in a direction toward the photosensitive drum 41, the portion P1 of the cushion member 438 positioned between the photosensitive drum 41 and the tubular portion 4322 becomes compressed between the developing shutter 437 and the tubular portion 4322, and the portion P2 of the cushion member 438 positioned opposite to the photosensitive drum 41 with respect to the tubular portion 4322 is restored from its compressed state to fill a space generated between the developing shutter 437 and the tubular portion 4322 due to the movement of the tubular portion 4322.

In this way, the cushion member 438 allows the tubular portion 4322 of the developing casing 432 to be moved relative to the developing shutter 437 while the developing shutter 437 is engaged with the toner cartridge 5, when the developing casing 432 is moved relative to the photosensitive drum 41 in the state where the drum cartridge 4 and the toner cartridge 5 are attached to the main casing 2, the developing shutter 437 is in the developing open position, and the toner shutter 54 is in the toner open position.

<3.6.2. Arrangement and Shape of Cushion Member 438>

In the present embodiment, the cushion member 438 has a hollow cylindrical shape. The cushion member 438 is positioned between the side wall 43211 and the flange portion 4323 in the first direction (see FIG. 6). Therefore, detachment of the cushion member 438 from a portion between the tubular portion 4322 and the developing shutter 437 due to movement of the cushion member 438 in the first direction can be restrained. The cushion member 438 has a first surface S51 and a second surface S52.

The first surface S51 is an inner surface of the cushion member 438. The first surface S51 makes contact with the outer circumferential surface of the tubular portion 4322 of the developing casing 432. In other words, the cushion member 438 makes contact with the tubular portion 4322.

The cushion member 438 may be affixed to the outer circumferential surface of the tubular portion 4322 with an adhesive, for example.

The second surface S52 is an outer surface of the cushion member 438. The second surface S52 makes contact with an inner circumferential surface of the developing shutter 437 to support the developing shutter 437. When the developing shutter 437 is moved between the developing closed position and the developing open position, the developing shutter 437 maintains contact with the second surface S52 and is slidingly moved on the second surface S52.

The cushion member 438 does not cover the toner inlet 433 and allows the toner to pass through the toner inlet 433. Meanwhile, the cushion member 438 surrounds an outer periphery of the toner inlet 433. As illustrated in FIG. 11, the cushion member 438 seals a portion between the tubular portion 4322 of the developing casing 432 and the developing shutter 437 when the developing shutter 437 is in the developing closed position, as the cushion member 438 is in contact with the outer circumferential surface of the tubular portion 4322 at the first surface S51 and in contact with the inner surface of the developing shutter 437 at the second surface S52 while surrounding the toner inlet 433. Accordingly, leakage of the toner from the portion between the developing casing 432 and the developing shutter 437 can be restrained.

<4. Advantageous Effects>

(1) In the image forming apparatus 1 according to the present embodiment, the cushion member 438 is positioned between the tubular portion 4322 of the developing casing 432 and the developing shutter 437, as illustrated in FIG. 12.

Accordingly, the developing casing 432 is movable relative to the developing shutter 437 while the developing shutter 437 is engaged with the toner cartridge 5, when the developing casing 432 is moved relative to the photosensitive drum 41 while the drum cartridge 4 and the toner cartridge 5 are attached to the main casing 2, the developing shutter 437 is in the developing open position, and the toner shutter 54 is in the toner open position.

This configuration can restrain the deviation in position of the developing shutter 437 relative to the toner cartridge 5 even when the developing casing 432 is moved relative to the photosensitive drum 41.

As a result, in a configuration in which toner is supplied from the toner cartridge 5 to the developing casing 432 which is movable relative to the photosensitive drum 41, the toner supplied from the toner cartridge 5 to the developing casing 432 can be kept from leaking.

(2) According to the image forming apparatus 1, the developing shutter 437 has the developing shutter opening 4371, as illustrated in FIG. 11. The developing shutter opening 4371 is not in communication with the toner inlet 433 when the developing shutter 437 is in the developing closed position. On the other hand, as illustrated in FIG. 12, the developing shutter opening 4371 is in communication with the toner inlet 433 when the developing shutter 437 is in the developing open position.

Further, the developing shutter opening 4371 is brought into communication with the toner outlet 511 as the drum cartridge 4 and the toner cartridge 5 are attached to the main casing 2, the developing shutter 437 is moved to the developing open position, and the toner shutter 54 is moved the toner open position.

With the above arrangement, a position of the developing shutter opening 4371 relative to the toner outlet 511 can be kept from changing when the developing casing 432 is moved relative to the photosensitive drum 41 while the drum cartridge 4 and the toner cartridge 5 are attached to the main casing 2, the developing shutter 437 is in the developing open position, and the toner shutter 54 is in the toner open position.

Consequently, in a configuration in which toner is supplied from the toner cartridge 5 to the developing casing 432 that is movable relative to the photosensitive drum 41, the toner supplied from the toner cartridge 5 to the developing casing 432 can be kept from leaking more reliably.

(3) According to the image forming apparatus 1, the cushion member 438 seals the portion between the tubular portion 4322 of the developing casing 432 and the developing shutter 437.

Therefore, the cushion member 438 can suppress leakage of the toner from the portion between the developing casing 432 and the developing shutter 437.

(4) According to the image forming apparatus 1, the developing shutter 437 is slidingly moved on the second surface S52 of the cushion member 438 while maintaining contact with the second surface S52 during the movement of the developing shutter 437 between the developing closed position (see FIG. 11) and the developing open position (see FIG. 12).

Accordingly, leakage of toner from the portion between the developing shutter 437 and the cushion member 438 when the developing shutter 437 is moved between the developing closed position and the developing open position can be restrained.

(5) According to the image forming apparatus 1, the developing shutter 437 extends in the first direction, as illustrated in FIGS. 11 and 12. Moreover, the developing shutter 437 has a hollow cylindrical shape.

Therefore, the developing shutter 437 is movable between the developing closed position and the developing open position by rotating.

Consequently, the space required for the movement the developing shutter 437 can be made small.

Moreover, this configuration can reduce a possibility that the developing casing 432 interferes with the developing shutter 437 even when the developing casing 432 is moved relative to the photosensitive drum 41.

(6) According to the image forming apparatus 1, the developing shutter 437 is positioned between the side wall 43211 and the flange portion 4323 in the first direction (see FIG. 6).

This arrangement can restrain the movement of the developing shutter 437 in the first direction which may cause detachment of the developing shutter 437 from the tubular portion 4322.

(7) According to the image forming apparatus 1, the toner cartridge 5 includes the handle 55 for moving the toner shutter 54, as illustrated in FIGS. 9 and 10.

Therefore, the user can move the toner shutter 54 easily by operating the handle 55.

(8) According to the image forming apparatus 1, the toner outlet 511 is positioned higher than the toner inlet 433 in the state where the drum cartridge 4 and the toner cartridge 5 are attached to the main casing 2, as illustrated in FIG. 12.

Therefore, even if a thickness of the cushion member 438 becomes greater, the toner accommodated in the toner cartridge 5 can be supplied to the developing unit 43 by use of the gravitational force regardless of the thickness of the cushion member 438.

(9) According to the image forming apparatus 1, the toner cartridge 5 is locked relative to the drum cartridge 4 in the state where the toner cartridge 5 is attached to the drum cartridge 4, the developing shutter 437 is in the developing open position, and the toner shutter 54 is in the toner open position, as illustrated in FIG. 10.

This configuration can prevent unintentional detachment of the toner cartridge 5 from the drum cartridge 4 when the developing shutter 437 is in the developing open position and the toner shutter 54 is in the toner open position.

<5. Modifications>

Hereinafter, various modifications to the embodiment will be described with reference to FIGS. 13 to 15C, wherein like parts and components are designated by the same reference numerals as those shown in the above-described embodiment to avoid duplicating description.

Figure 13:
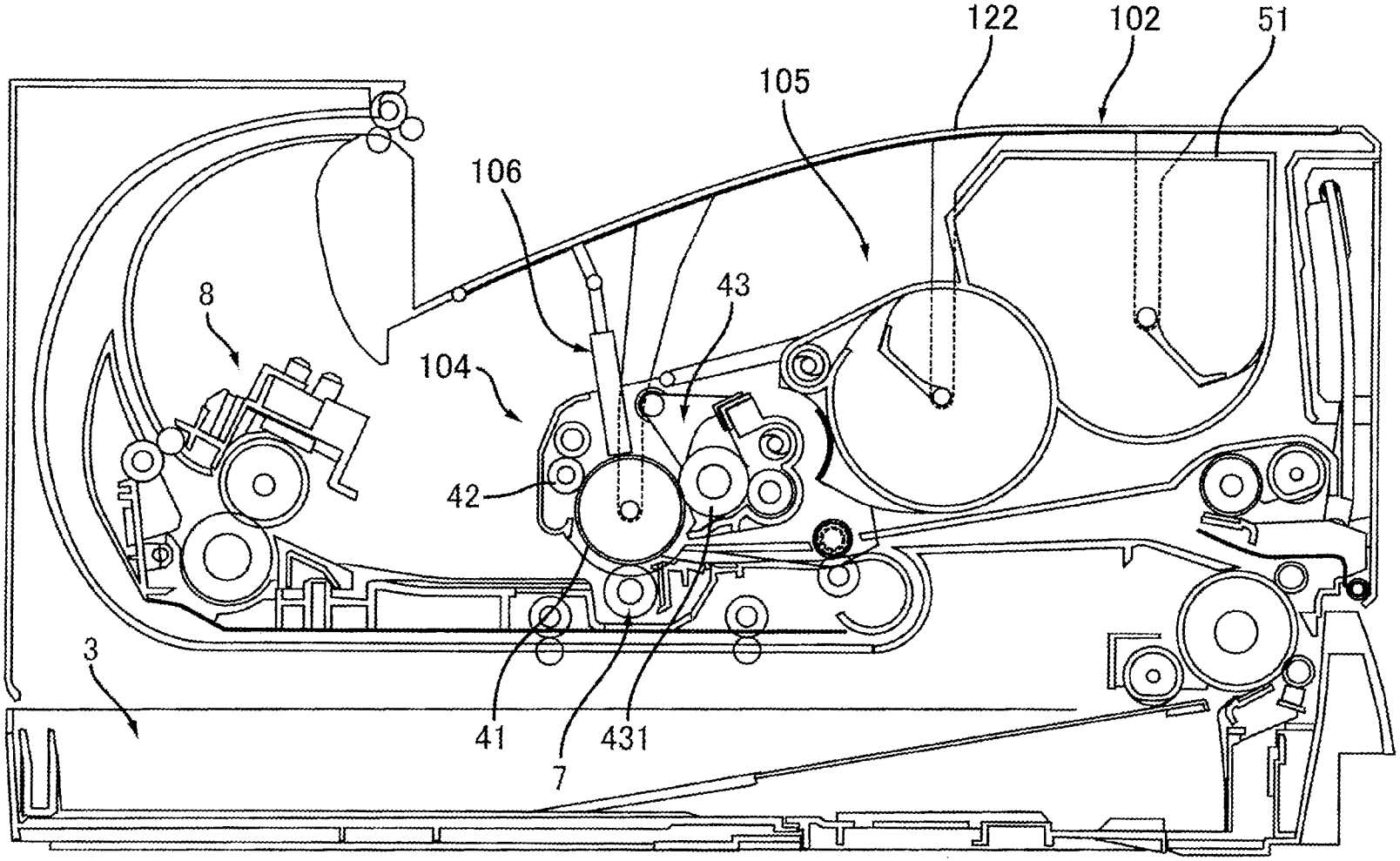
FIG. 13 is a view illustrating an image forming apparatus according to a first modification, and illustrating a state where a drum cartridge and a toner cartridge are attached to a main casing of the image forming apparatus.
Figure 14:
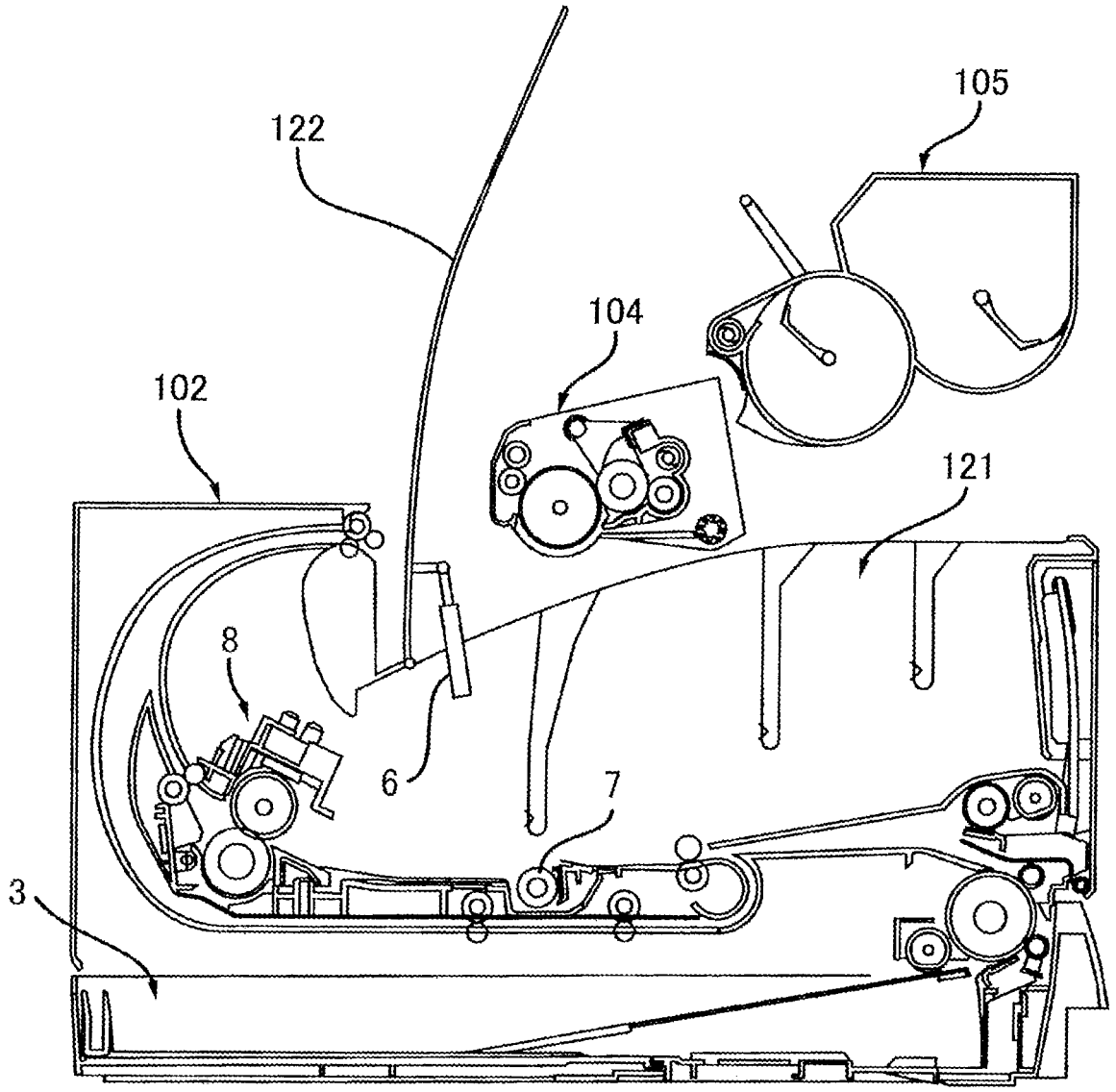
FIG. 14 is a view illustrating the image forming apparatus according to the first modification, and illustrating a state where the drum cartridge and the toner cartridge are detached from the main casing.

(1) FIGS. 13 and 14 illustrate a first modification to the embodiment employing an image forming apparatus 101 including a main casing 102. In this modification, a toner cartridge 105 and a drum cartridge 104 is attachable to the main casing 102 independently from each other. That is, the toner cartridge 105 is attachable directly to the main casing 102 without being attached to the drum cartridge 104. Further, an opening 121 is formed in an upper wall of the main casing 102, and a cover 122 is configured to open and close the upper opening 121. Still further, the image forming apparatus 101 illustrated in FIGS. 13 and 14 includes an exposure unit 106 which is an LED head. The exposure unit 106 may be supported by the cover 122.

Figure 15A:
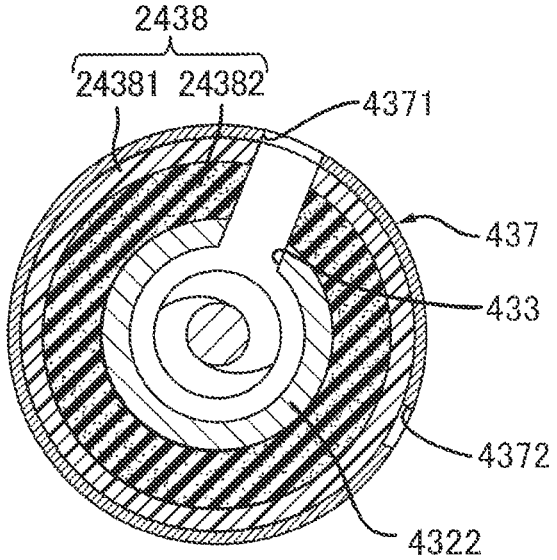
FIG. 15A is a view illustrating a configuration of a cushion member in an image forming apparatus according to a second modification.

(2) FIG. 15A illustrates a second modification to the embodiment in which a cushion member 2438 is employed instead of the cushion member 438. In this second modification, the cushion member 2438 includes a first layer 24381 and a second layer 24382.

The first layer 24381 constitutes an outer portion of the cushion member 2438, i.e., positioned radially outward of the second layer 24382. The first layer 24381 may be affixed to the second layer 24382 with an adhesive, for example. The first layer 24381 makes contact with the developing shutter 437. The first layer 24381 is made of a hard resin, for example. The first layer 24381 is not deformed when the developing casing 432 is moved relative to the photosensitive drum 41 while the drum cartridge 4 and the toner cartridge 5 are attached to the main casing 2, the developing shutter 437 is in the developing open position, and the toner shutter 54 is in the toner open position. Accordingly, the toner shutter 54 can be supported more stably by using the first layer 24381.

The second layer 24382 is interposed between the first layer 24381 and the tubular portion 4322 of the developing casing 432. The second layer 24382 may be affixed to the outer circumferential surface of the tubular portion 4322 with an adhesive, for example. The second layer 24382 has a flexibility greater than that of the first layer 24381. The second layer 24382 is made of an elastic material, such as sponge, for example. The second layer 24382 is elastically deformed when the developing casing 432 is moved relative to the photosensitive drum 41 while the drum cartridge 4 and the toner cartridge 5 are attached to the main casing 2, the developing shutter 437 is in the developing open position, and the toner shutter 54 is in the toner open position. With the above configuration, the second layer 24382 allows the movement of the tubular portion 4322 of the developing casing 432 relative to the developing shutter 437.

(3) The cushion member 438 may not have a cylindrical shape. Further, the toner cartridge 5 may include a plurality of cushion members 438.

Figure 15B:
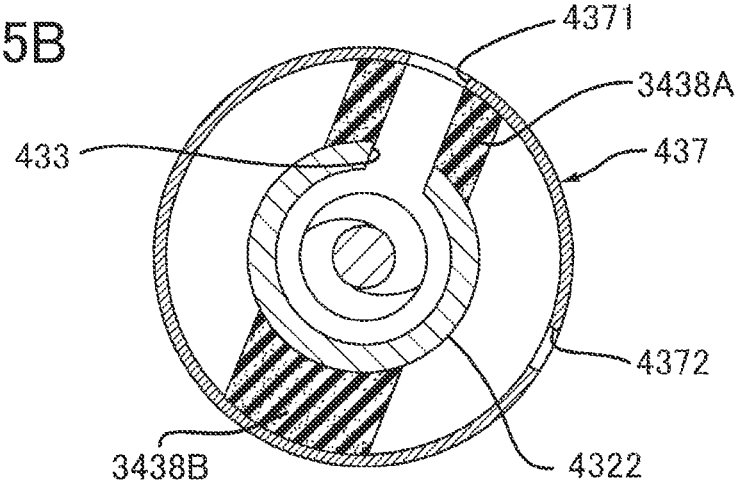
FIG. 15B is a view illustrating a configuration of a cushion member in an image forming apparatus according to a third modification.

Specifically, FIG. 15B illustrates a third modification to the embodiment in which the drum cartridge 4 includes two cushion members 3438A and 3438B. The cushion member 438A is provided to surround the toner inlet 433. The cushion member 3438B is positioned opposite to the cushion member 3438A with respect to the tubular portion 4322. In this case, each of the cushion members 3438A and 3438B has a stick-like shape extending in the first direction.

Figure 15C:
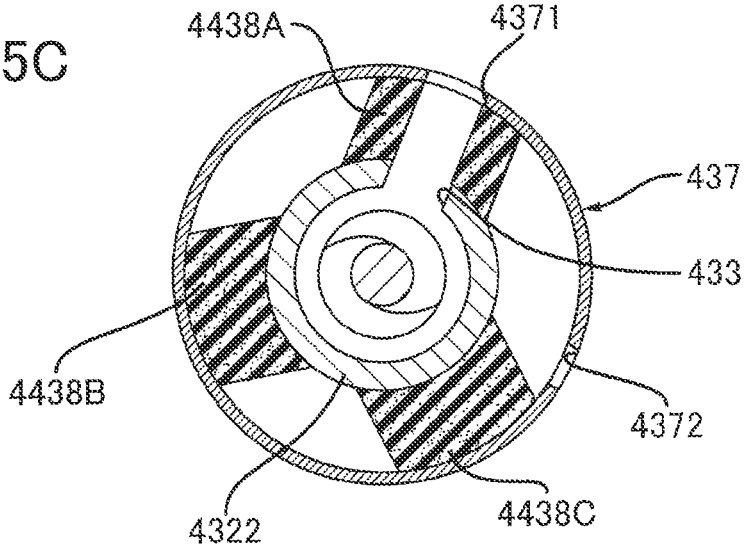
FIG. 15C is a view illustrating a configuration of a cushion member in an image forming apparatus according to a fourth modification.

Further, FIG. 15C illustrates a fourth modification to the embodiment in which the drum cartridge 4 includes three cushion members 4438A, 4438B, and 4438C. The cushion member 4438A surrounds the toner outlet 511. Each of the cushion members 4438B and 4438C are positioned to be spaced apart from the cushion member 3438A in a circumferential direction of the tubular portion 4322. In this modification, each of the cushion members 4438A, 4438B, and 4438C has a stick-like shape extending in the first direction.

(4) The tubular portion 4322 need not have a cylindrical shape. Instead, the tubular portion 4322 may have a polygonal tubular shape, such as a rectangular tubular shape, a hexagonal tubular shape, and an octagonal tubular shape. In a case where the tubular portion 4322 has a polygonal tubular shape, the cushion member 438 may be a tubular member with a hole that has a shape identical to an outer shape of the polygonal tubular portion 4322. In this case, the cushion member 438 may not be affixed to a peripheral surface of the polygonal tubular portion 4322.

(5) The developing casing 432 may be slidingly movable in the second attachment direction relative to the photosensitive drum 41. In this case, the second attachment direction serves as a second direction.

While the description has been made in detail with reference to the embodiments, it would be apparent to those skilled in the art that many modifications and variations may be made thereto.

What is claimed is:

1. An image forming apparatus comprising:

a main casing;

a toner cartridge attachable to the main casing, the toner cartridge comprising:

a toner casing for accommodating toner therein, the toner casing being formed with a toner outlet allowing the toner accommodated in the toner casing to be discharged to an outside of the toner casing therethrough; and a toner shutter movable between a toner closed position where the toner shutter closes the toner outlet and a toner open position where the toner shutter opens the toner outlet; and a drum cartridge attachable to the main casing, the drum cartridge being for receiving the toner from the toner cartridge in a state where the drum cartridge and the toner cartridge are attached to the main casing, the drum cartridge comprising:

a photosensitive drum rotatable about a drum axis extending in a first direction; and a developing unit for supplying toner to the photosensitive drum, the developing unit comprising:

a developing roller rotatable about a developing axis extending in the first direction;

a developing casing supporting the developing roller and movable relative to the photosensitive drum in a second direction crossing the first direction, the developing casing being formed with a toner inlet allowing the toner discharged from the toner casing through the toner outlet to enter the developing casing therethrough; and a developing shutter movable in a moving direction between a developing closed position where the developing shutter closes the toner inlet and a developing open position where the developing shutter opens the toner inlet, the developing shutter being supported so as to be movable relative to the toner inlet in a direction different from the moving direction of the developing shutter, the developing shutter being in engagement with the toner cartridge in the state where the drum cartridge and the toner cartridge are attached to the main casing, wherein during a process in which the toner cartridge is locked relative to the drum cartridge in a state where the toner cartridge is in engagement with the drum cartridge, the toner shutter and the developing shutter are moved integrally from the toner closed position and the developing closed position to the toner open position and the developing open position, respectively.

2. The image forming apparatus according to claim 1, wherein the toner cartridge further comprises a handle for moving the toner shutter, and wherein in a state where the toner cartridge is in engagement with the drum cartridge and the toner shutter is in the toner open position, the toner cartridge is locked relative to the drum cartridge.

3. The image forming apparatus according to claim 1, further comprising a cushion member positioned between the developing casing and the developing shutter, wherein the cushion member supports the developing shutter so that the developing shutter is movable relative to the developing casing in the direction different from the moving direction of the developing shutter.

4. The image forming apparatus according to claim 3, wherein the cushion member surrounds an outer periphery of the toner inlet, the cushion member sealing a portion between the developing casing and the developing shutter in a state where the developing shutter is in the developing closed position.

5. The image forming apparatus according to claim 3, wherein the cushion member has:

a first surface for making contact with the developing casing; and a second surface for making contact with the developing shutter.

6. The image forming apparatus according to claim 5, wherein during movement of the developing shutter between the developing closed position and the developing open position, the developing shutter is slidingly moved on the second surface while maintaining contact with the second surface.

7. The image forming apparatus according to claim 6, wherein the developing shutter has a hollow cylindrical shape and extends in the first direction.

8. The image forming apparatus according to claim 7, wherein the developing shutter is supported by the cushion member so as to be movable in a radial direction of the developing shutter relative to the toner inlet.

9. The image forming apparatus according to claim 3, wherein the direction different from the moving direction of the developing shutter is a radial direction of the developing shutter.

10. The image forming apparatus according to claim 1, wherein during a process in which lock of the toner cartridge relative to the drum cartridge is released in the state where the toner cartridge is in engagement with the drum cartridge, the toner shutter and the developing shutter are moved integrally from the toner open position and the developing open position to the toner closed position and the developing closed position, respectively.

* * * * *